US008424260B2

(12) United States Patent
Bjorkman

(10) Patent No.: US 8,424,260 B2
(45) Date of Patent: Apr. 23, 2013

(54) FLOOR PANEL AND FLOORING DRAINAGE SYSTEM

(71) Applicant: Weyerhaeuser NR Company, Federal Way, WA (US)

(72) Inventor: Travis E. Bjorkman, Bonney Lake, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 0 days.

(21) Appl. No.: 13/652,606

(22) Filed: Oct. 16, 2012

(65) Prior Publication Data

US 2013/0036690 A1 Feb. 14, 2013

Related U.S. Application Data

(62) Division of application No. 13/052,664, filed on Mar. 21, 2011, now Pat. No. 8,333,044.

(51) Int. Cl.
*E04B 1/70* (2006.01)
*E04F 17/00* (2006.01)

(52) U.S. Cl.
USPC ..... 52/302.1; 52/592.1

(58) Field of Classification Search ..... 52/302.1, 52/302.3, 302.4, 589.1, 592.1, 592.4
See application file for complete search history.

(56) References Cited

U.S. PATENT DOCUMENTS

| | | | | |
|---|---|---|---|---|
| 2,807,993 | A * | 10/1957 | Ericson | 454/298 |
| 4,362,426 | A * | 12/1982 | Ruckstuhl | 404/40 |
| 5,182,892 | A * | 2/1993 | Chase | 52/539 |
| 5,335,473 | A * | 8/1994 | Chase | 52/745.08 |
| 6,145,261 | A * | 11/2000 | Godfrey et al. | 52/302.1 |
| 2007/0081858 | A1 * | 4/2007 | Yee | 404/40 |

* cited by examiner

*Primary Examiner* — Brian Glessner
*Assistant Examiner* — Brian D Mattei
(74) *Attorney, Agent, or Firm* — Weyerhaeuser Law Dept

(57) ABSTRACT

The present disclosure is directed generally towards floor panels and flooring drainage systems utilizing two or more interconnected improved floor panels. In some embodiments, the disclosure includes a floor panel having a top surface, a bottom surface, a first longitudinal surface, a second longitudinal surface, a first transverse surface, and a second transverse surface. One or more drainage assemblies are located on either the first transverse surface and/or the second transverse surface. Each of the drainage assemblies include one or more drainage slots and one or more drainage notches. Further aspects are directed towards flooring drainage systems comprising two or more interconnected floor panels according to embodiments of the disclosure.

20 Claims, 30 Drawing Sheets

FLOOR PANEL AND FLOORING DRAINAGE SYSTEM

CROSS REFERENCE TO RELATED APPLICATION

This application is entitled to and claims the benefit of priority under 35 U.S.C. §119 from U.S. Nonprovisional patent application Ser. No. 13/052,664 filed Mar. 21, 2011, and titled "FLOOR PANEL AND FLOORING DRAINAGE SYSTEM," the contents of which are incorporated herein by reference.

TECHNICAL FIELD

The present disclosure is directed generally to improved floor panels and flooring drainage systems utilizing two or more interconnected improved floor panels.

BACKGROUND

Structural boards having tongue and groove elements (T&G boards) are frequently used in the construction industry to construct flooring assemblies. T&G boards are typically 4 feet wide and 8 feet long and are constructed from plywood, particle board, strand board, or other types of engineered wood products. Conventionally, each T&G board features a tongue element protruding from one of the 8 foot-long sides and a groove element extending into the other 8 foot-long side. These elements allow multiple T&G boards to be interconnected for construction of a flooring system.

T&G boards are well-suited for installation on a joist framing assembly to form a structural sub-floor. T&G boards serve especially well as sub-flooring because of their inter-locking edges which reduce vertical offset between adjacent boards resulting in a smoother floor. In addition, the interconnected edges prevent relative movement between adjacent edges as persons walk on the floor, thereby reducing squeaking and other undesirable effects. Typically, tile, carpet, or hardwood flooring is installed over the structural sub-floor to provide a finished floor surface.

Although T&G boards are very useful in flooring applications, they are subject to damage if water accumulates on the sub-floor surface during construction of the building. Rain or snow before completion often causes the accumulation of pools of water on the assembled sub-floor. As a result, the T&G boards may buckle, swell, absorb a greater amount of water, or otherwise incur damage.

In response to this problem, the wood products and construction industries have experimented with a number of solutions. Some solutions involve water-resistant coatings, chemical additives, or stabilizing agents designed for reducing water absorption. Other solutions involve drainage systems, which encourage water to drain off the sub-floor surface before the damage is caused. Although many of these solutions reduce water damage to T&G boards, the costs of implementation are often prohibitive. In addition, despite implementation of these solutions, water often does not drain fast enough and the T&G boards may still swell or buckle. In some situations, sawdust or other types of construction debris may inhibit drainage of water. Accordingly, there is a need in the industry to develop improved floor panels and flooring drainage systems that are effective to quickly drain water in a construction while at the same time being economical to produce. Ideally, such floor panels and flooring drainage systems will be effective to reduce the total amount of water absorbed in a floor panel when compared with current commercially available solutions.

SUMMARY

The following summary is provided for the benefit of the reader only and is not intended to limit in any way the invention as set forth by the claims. The present disclosure is directed generally towards floor panels and flooring drainage systems utilizing two or more interconnected improved floor panels.

In some embodiments, the disclosure includes a floor panel having a top surface, a bottom surface, a first longitudinal surface, a second longitudinal surface, a first transverse surface, and a second transverse surface. The first transverse surface and second transverse surface are substantially shorter in length than the first longitudinal surface and the second longitudinal surface. One or more drainage assemblies are located on either the first transverse surface and/or the second transverse surface. Each of the drainage assemblies include one or more drainage slots and one or more drainage notches. The drainage slots each comprise a first opening on the bottom surface of the floor panel. The drainage notches each are configured to facilitate entry of water into each of the drainage slot(s).

In other embodiments, the disclosure includes a floor panel having a first drainage assembly, second drainage assembly, and a third drainage assembly. Each of the first, second, and third drainage assemblies are located on the first transverse surface of the floor panel and include a drainage slot and a drainage notch. In some embodiments, the drainage notch includes a first opening on the bottom surface of the floor panel. The drainage slot may be a second opening extending into the first transverse surface of the floor panel.

Further aspects are directed towards flooring drainage systems comprising two or more interconnected floor panels. Each of the interconnected floor panels include one or more drainage assemblies as described in the disclosure. In some embodiments, the drainage assemblies each include one or more drainage notches and slots located on the first transverse surface of the panel. In some embodiments, the drainage assemblies include one or more notches located on the first transverse surface of the panel and one or more slots located on the second transverse surface of the panel. In some embodiments, the drainage assemblies include one or more drainage slots (but no drainage notches) located on the either first transverse surface or the second transverse surface of the floor panel.

BRIEF DESCRIPTION OF THE DRAWINGS

The present disclosure is better understood by reading the following description of non-limitative embodiments with reference to the attached drawings wherein like parts of each of the figures are identified by the same reference characters, and are briefly described as follows:

FIG. 3 is a perspective view of an embodiment of a drainage assembly according to the disclosure;

DETAILED DESCRIPTION

The present disclosure describes floor panels and flooring drainage systems utilizing two or more interconnected improved floor panels. Certain specific details are set forth in the following description and FIGS. 1-31 to provide a thorough understanding of various embodiments of the disclosure. Well-known structures, systems, and methods often associated with such systems have not been shown or described in detail to avoid unnecessarily obscuring the description of various embodiments of the disclosure. In addition, those of ordinary skill in the relevant art will understand that additional embodiments of the disclosure may be practiced without several of the details described below.

In this disclosure, the terms "composite wood product" or "engineered wood product" are used interchangeably. Both terms refer to a range of derivative wood products which are manufactured by binding together the strands, particles, fibers, or veneers of wood, together with adhesives, to form composite materials. Examples of composite wood products or engineered wood products include, but are not limited to oriented strand board, plywood, particle board, oriented strand lumber, laminated strand lumber, and parallel strand lumber. The term "notches" and the term "slots" are used interchangeably in this disclosure to mean an indentation in a surface having any shape.

Figure 1:
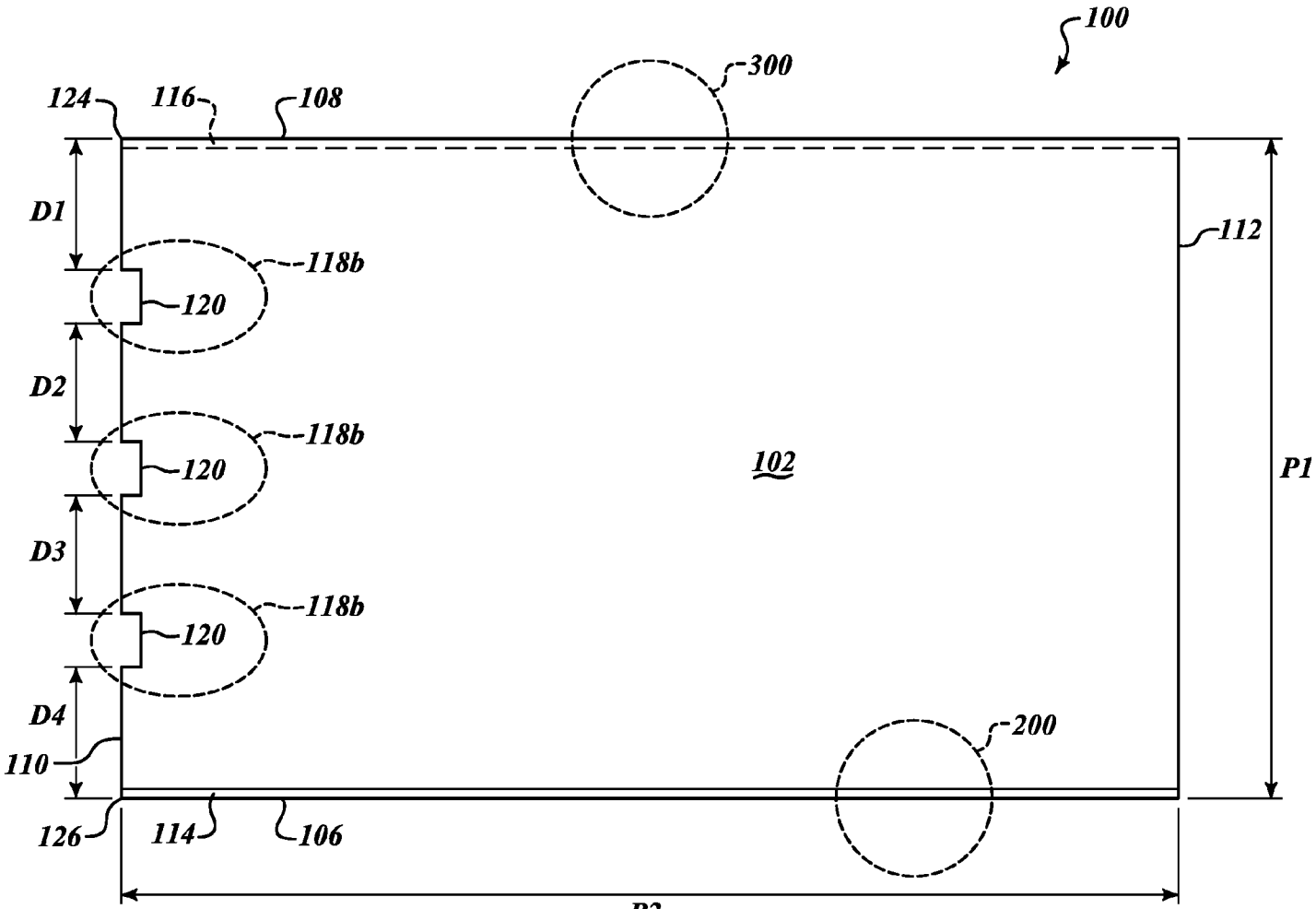
FIG. 1 is a top plan view of a floor panel according to embodiments of the disclosure.
Figure 2:
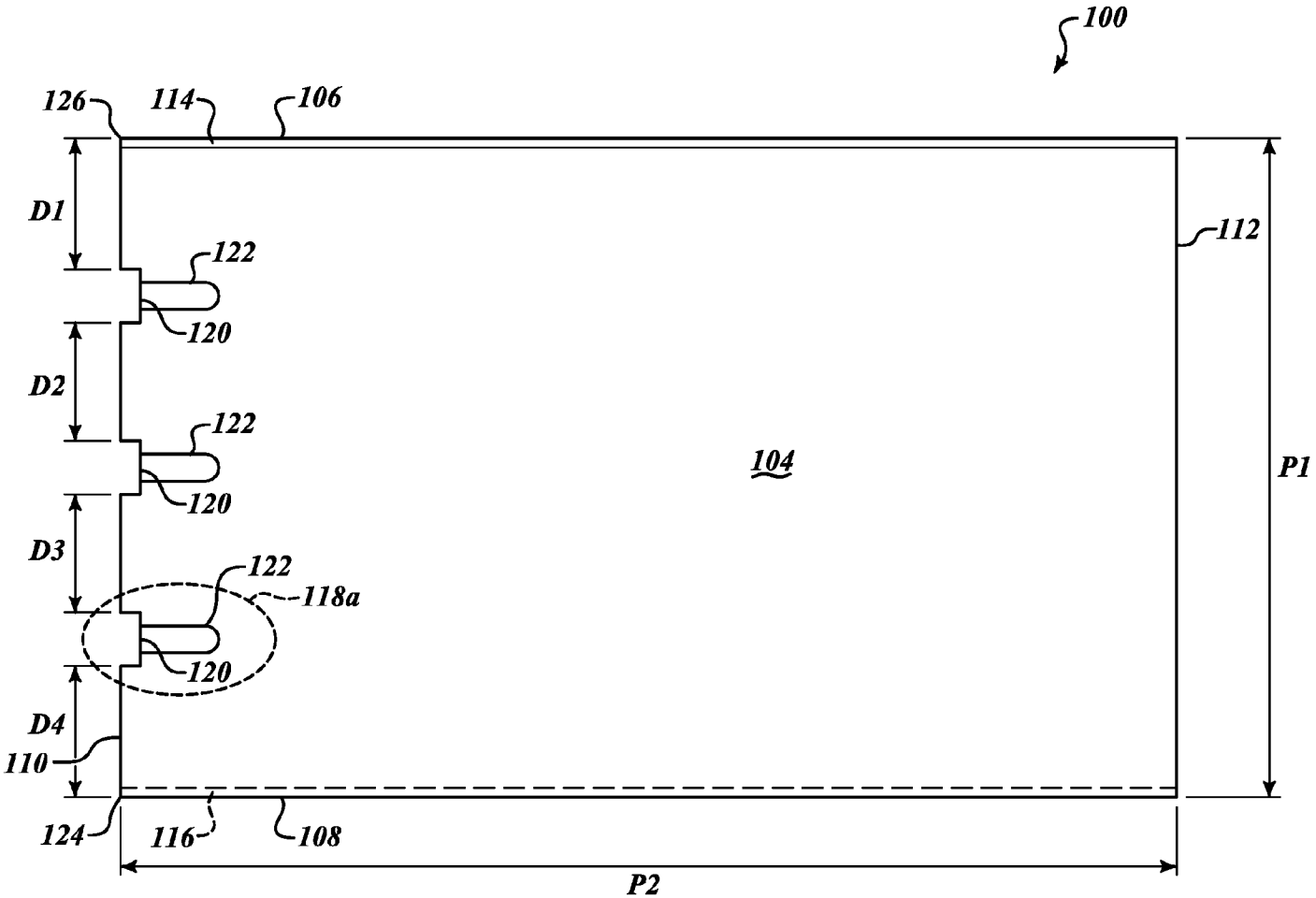
FIG. 2 is a bottom plan view of the floor panel shown in FIG. 1.
Figure 3:
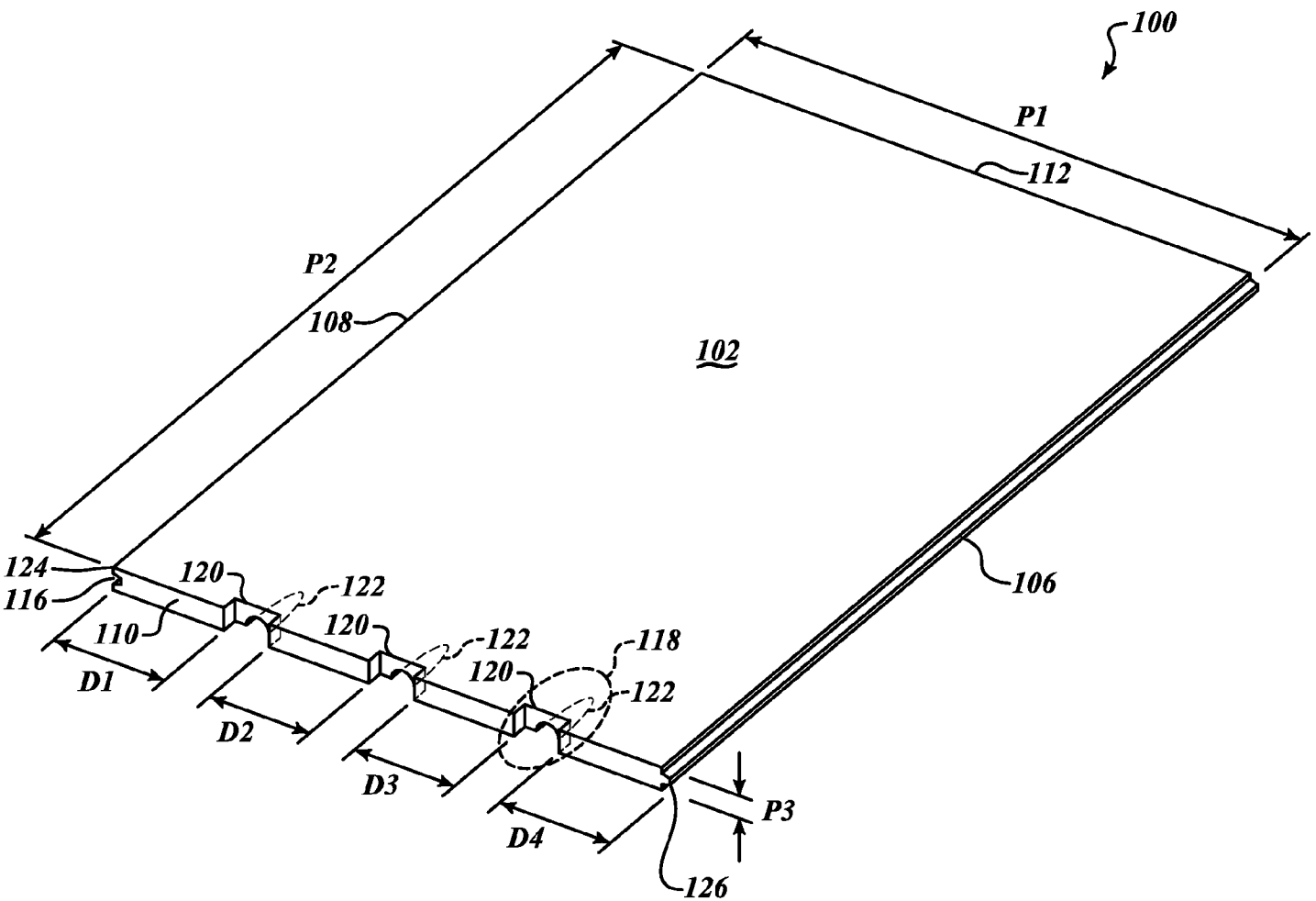
FIG. 3 is a perspective view of the floor panel shown in FIGS. 1 and 2.
Figure 5:
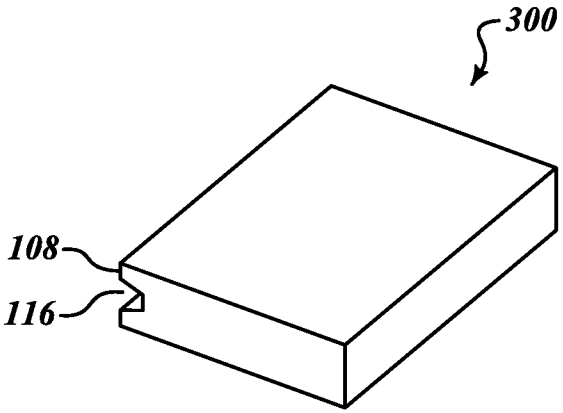
FIG. 5 is a perspective view of a is a perspective view of a groove according to embodiments of the disclosure, first shown in FIGS. 1 and 2.
Figure 4:
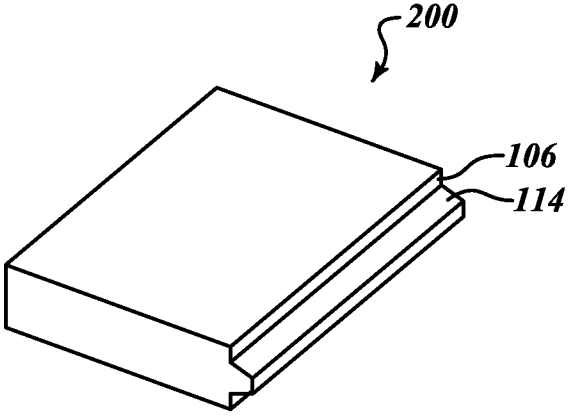
FIG. 4 is a perspective view of a tongue according to embodiments of the disclosure, first shown in FIGS. 1 and 2.

Referring to FIGS. 1 through 3, a floor panel 100 according to embodiments of the disclosure is shown from various perspectives. FIG. 1 is a top plan view of the floor panel 100. Floor panels 100 according to embodiments of the disclosure are typically constructed from composite wood products; however, floor panels could also be made from solid wood products or any other material that would be suitable for construction of flooring based on the knowledge of a person ordinary skill in the art. Referring to FIGS. 1 and 2, the floor panel 100 has a top surface 102, a bottom surface 104, a first longitudinal surface 106, a second longitudinal surface 108, a first transverse surface 110, and a second transverse surface 112.

Floor panels 100 according to the disclosure may have any suitable dimensions based on the market for construction materials used in residential and commercial construction. Generally, the first transverse surface 110 and the second transverse surface 112 have a length P1 that is substantially shorter than the length P2 of the first longitudinal surface 106 and the second longitudinal surface 108. Referring to FIG. 3, floor panels 100 according to the disclosure have a thickness P3 that is substantially smaller than both P1 and P2. Generally, P1 may range from about 3 feet to about 4 feet, P2 may range from about 6 feet to about 8 feet, and P3 may range from about ⅝ of an inch to about 1 and ⅛ of an inch. In a non-limiting example, a floor panel 100 according to the disclosure may have the following dimensions: P1=approximately 4 feet, P2=approximately 8 feet, and P3=approximately ¾ of an inch.

Referring to FIGS. 1-3, the first longitudinal surface 106 is shown having a longitudinally-extending tongue 114. The second longitudinal surface 108 has longitudinally-extending groove 116. Tongue portion 200 of the floor panel 100 is shown in further detail in FIG. 4 and groove portion 300 is shown in further detail in FIG. 5. In embodiments according to the disclosure, the tongue 114 of a first floor panel is designed to fit into the groove 116 of a second floor panel, thereby interlocking the first and second floor panel. Tongue and groove mechanisms that are known to a person or ordinary skill, for example those disclosed in U.S. Pat. No. 6,145,261 (the contents of which are hereby incorporated by reference) may also be used with floor panels 100 according to embodiments of the disclosure.

As shown in FIGS. 1-3, floor panels 100 according to the disclosure feature one or more drainage assemblies 118. Specific details about the various types and configurations of drainage assemblies 118 will be described later in this disclosure. In the non-limiting example shown in FIGS. 1-3, three drainage assemblies (a first drainage assembly 118*a*, a second drainage assembly 118*b*, and a third drainage assembly 118*c*) are shown arranged on the first transverse surface 110 of the floor panel 100. Alternatively, the drainage assemblies 118 may be arranged on the second transverse surface 112 of the floor panel 100. In some embodiments, the drainage assemblies 118 may be arranged so that the spacing between each of the drainage assemblies 118 (D1, D2, D3, and D4) is substantially equal.

In other embodiments, the first drainage assembly 118*a* may be located approximately 10 inches from a first end 124 of the first transverse surface 110 and the third drainage assembly 118*c* may be located approximately 10 inches from a second end 126 of the first transverse surface 110. The second drainage assembly 118*b* may be arranged on the first transverse surface 110 between the first drainage assembly 118*a* and the third drainage assembly 118*c*. Accordingly, in some embodiments, D1 is approximately 10 inches, D2 is approximately 13 and ½ inches, D3 is approximately 13 and ½ inches and D4 is approximately 10 inches. A person of ordinary skill in the art will appreciate that the above-mentioned dimensions may change based on the size of the drainage assembles 118, the nailing schedule for the panel, or the configuration of the manufacturing equipment used to machine the drainage assemblies 118.

FIGS. 6-16 depict various views of different types of drainage assemblies 118 according to embodiments of the disclosure. In FIGS. 6-16, each of the drainage assemblies 118 include a drainage notch 120 and a drainage slot 122. Drainage slots 122 according to embodiments of the disclosure may include a first opening on the bottom surface 104 of the floor panel 100. Drainage notches 120 according to embodiments of the disclosure may have any configuration suitable to facilitate entry of water into the drainage slot(s) 122. For example, drainage notches 120 according to embodiments of the disclosure may include a second opening extending from the top surface 102 of the floor panel to the bottom surface 104 of the floor panel 110 and into the first transverse surface 110 towards the second transverse surface 112 if the drainage assembly or assemblies 118 is/are located on the first transverse surface 110. If the drainage assembly or assemblies 118 are located on the second transverse surface 112 of the floor panel 110, drainage notches 120 according to embodiments of the disclosure may include a second opening extending from the top surface 102 of the floor panel to the bottom surface 104 of the floor panel 110 and into the second transverse surface 112 towards the first transverse surface 110.

Drainage notches 120 and drainage slots 122 according to embodiments of the disclosure may have various shapes, features, and dimensions. In FIGS. 6, 7, 9, 10, 13, 14, and 15, the drainage slots 122 shown are openings comprising a substantially cylindrical shape. In FIGS. 8, 11 and 16, the drainage slots 122 shown are openings comprising a substantially rectangular shape. In FIGS. 7, 9, 10, 13, 14, and 15, the drainage notches 120 shown are openings comprising a substantially semi-circular profile when viewed from the top. In FIGS. 6, 8, 11, 12, and 16, the drainage notches 120 shown are openings comprising a substantially rectangular profile when viewed from the top. A person of ordinary skill in the art will appreciate that various other shapes for drainage slots 122 and drainage notches 120 (e.g., triangular, oval, etc.) may be used in accordance with embodiments described in the disclosure.

Figure 6:
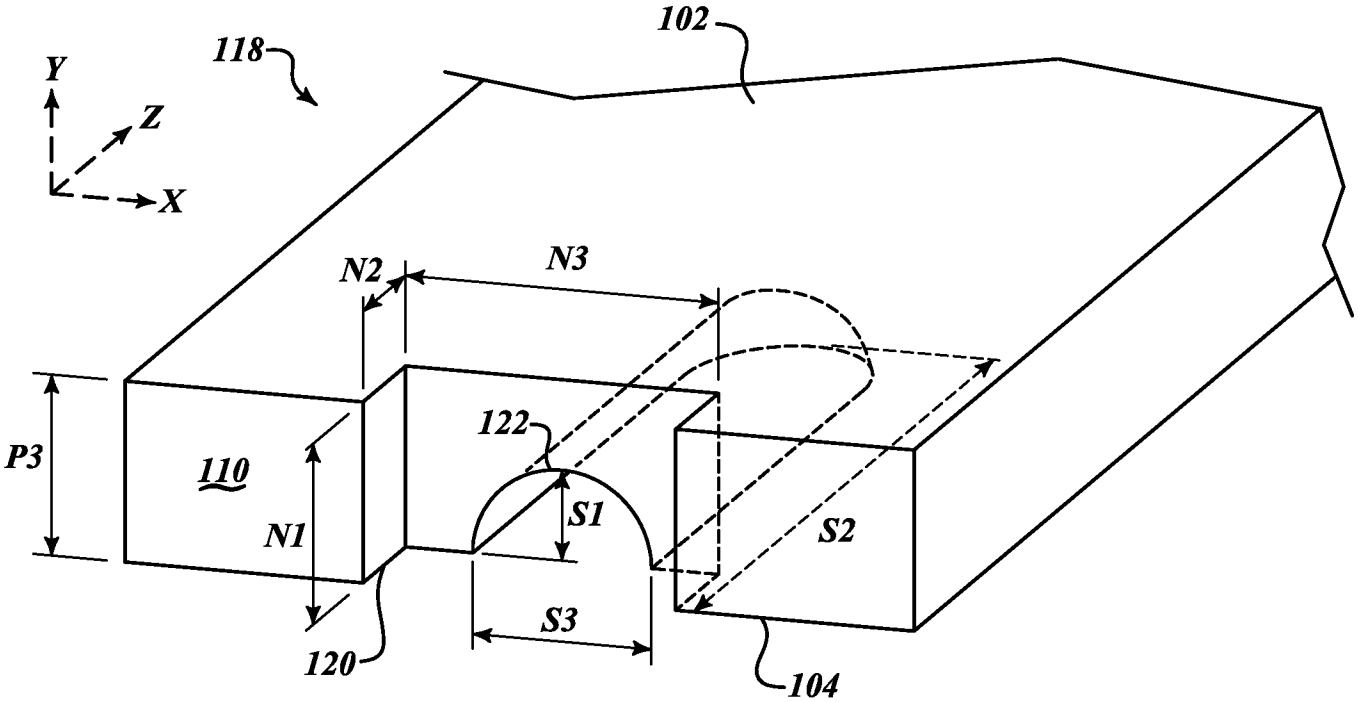
FIG. 6 is a perspective view of an embodiment of a drainage assembly according to the disclosure.
Figure 7:
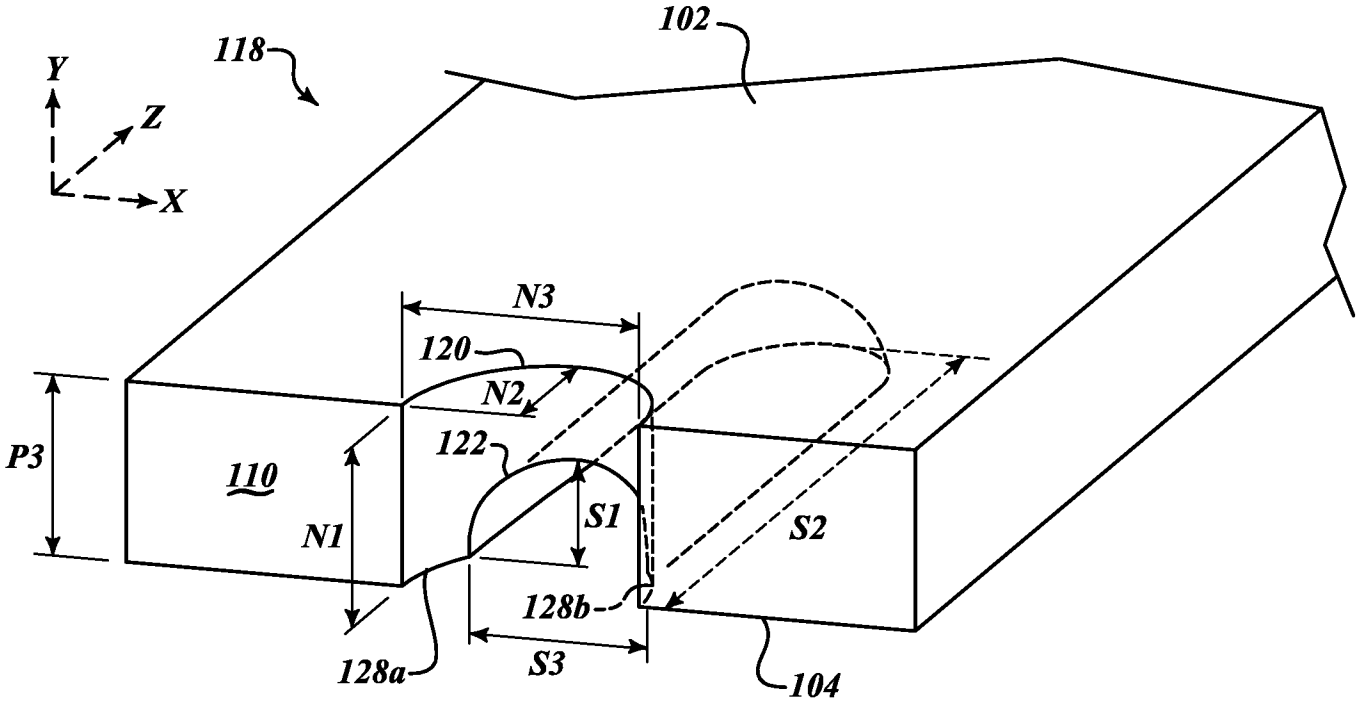
FIG. 7 is a perspective view of another embodiment of a drainage assembly according to the disclosure.
Figure 8:
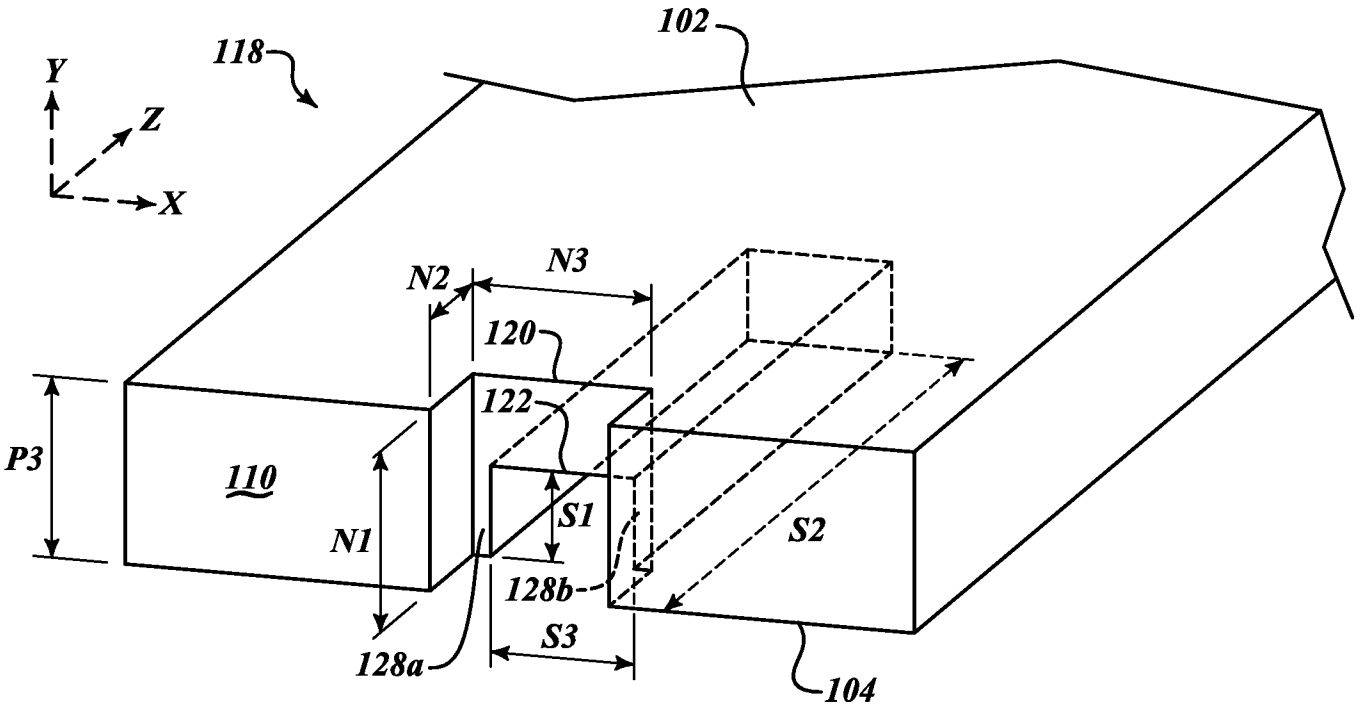
FIG. 8 is a perspective view of yet another embodiment of a drainage assembly according to the disclosure.

FIGS. 6, 7, and 8 are perspective views of embodiments of drainage assemblies 118 according to the disclosure arranged on an axis system comprising an x-axis X (width), a y-axis Y (height) and a Z-axis (depth). As shown, each drainage notch 120 is located at substantially the same position on the floor panel 100 (e.g., in this case on the first transverse surface 110) as each drainage slot 122. Each drainage slot 122 includes an opening having a slot height S1, a slot depth S2, and a slot width S3. Each drainage notch 120 includes an opening having a notch height N1, a notch depth N2, and a notch width N3. Further, in the embodiments shown, the drainage notch 120 is positioned so that is effectively located on top of the drainage slot 122.

The slot depth S2 may be substantially larger than the notch depth N2. The disclosure is intended to cover drainage slots 122 having a slot depth S2 ranging anywhere from approximately 1/16 inches to approximately ¼ inches. Although FIGS. 6, 7, and 8 show an embodiment of a drainage slot 122 having a constant slot depth S2, the slot depth S2 may also be tapered or otherwise vary. In the embodiments shown, the drainage slot 122 and the drainage notch 120 are positioned so that they are substantially perpendicular to the first transverse surface 110. The disclosure is intended to cover drainage notches 120 having notch depths N2 ranging from approximately ¾ inches to approximately 3 inches.

Figure 9:
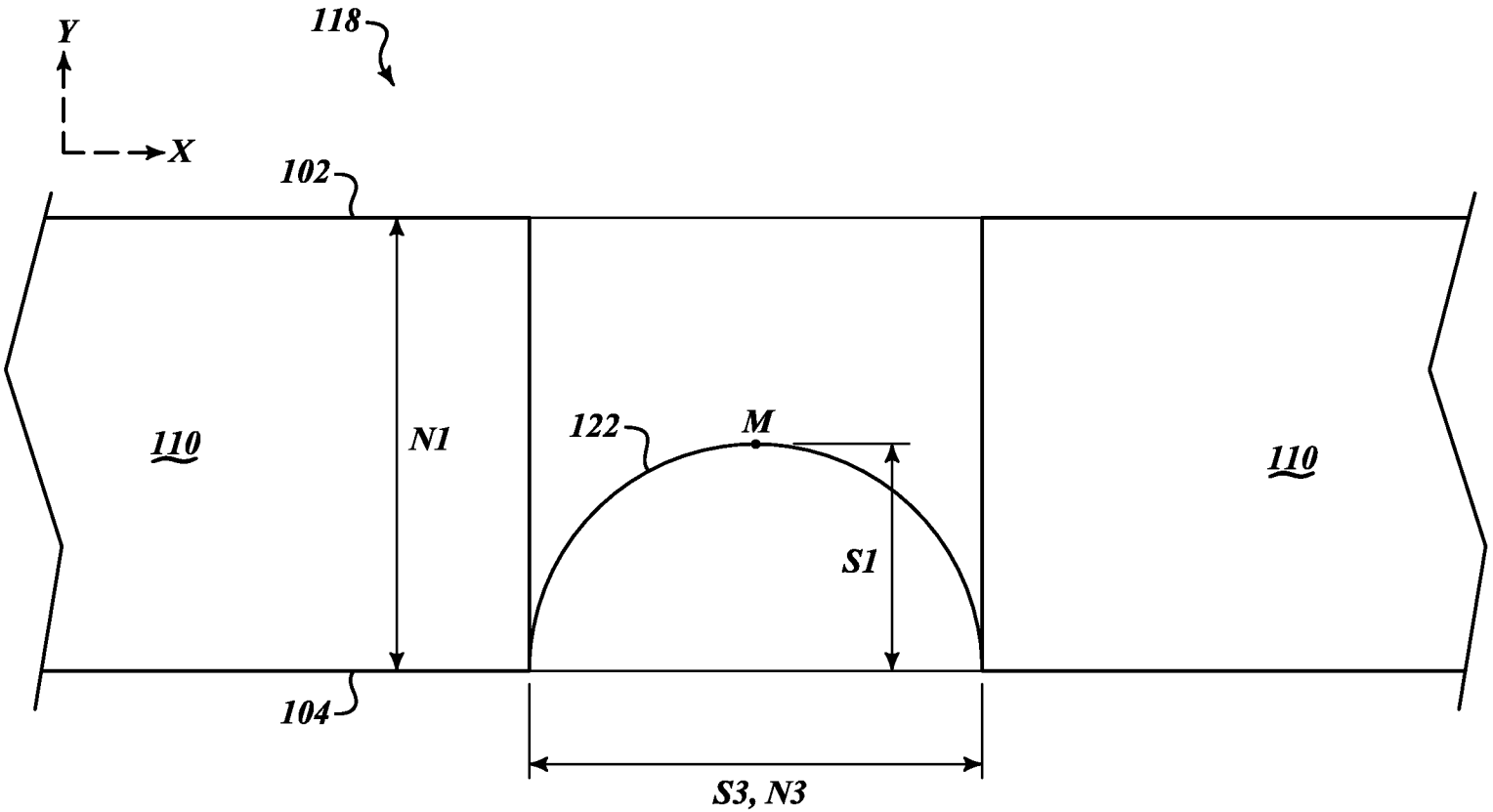
FIG. 9 is a side view of the drainage assembly shown in FIG. 6.
Figure 10:
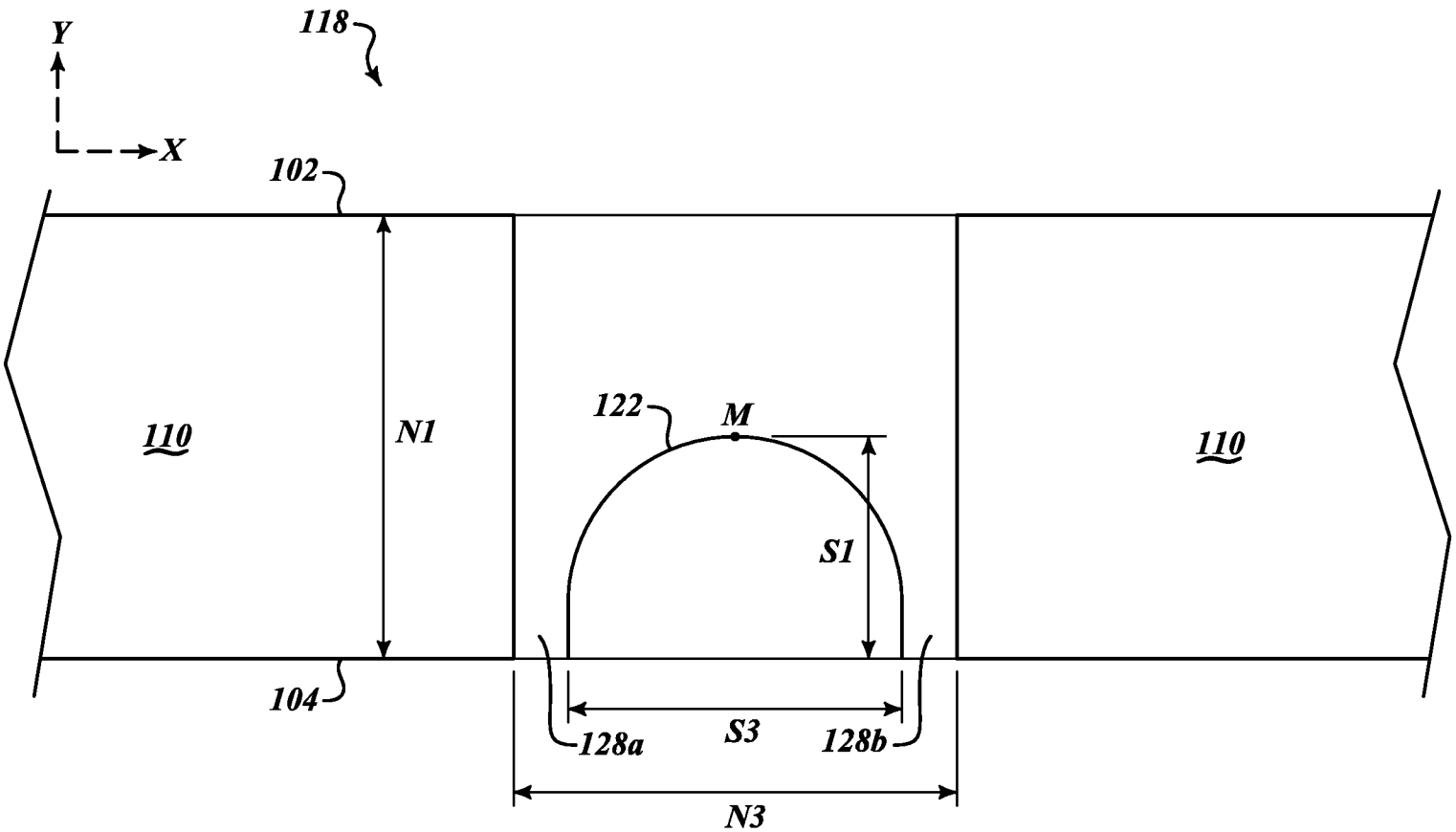
FIG. 10 is a side view of the drainage assembly shown in FIG. 7.
Figure 11:
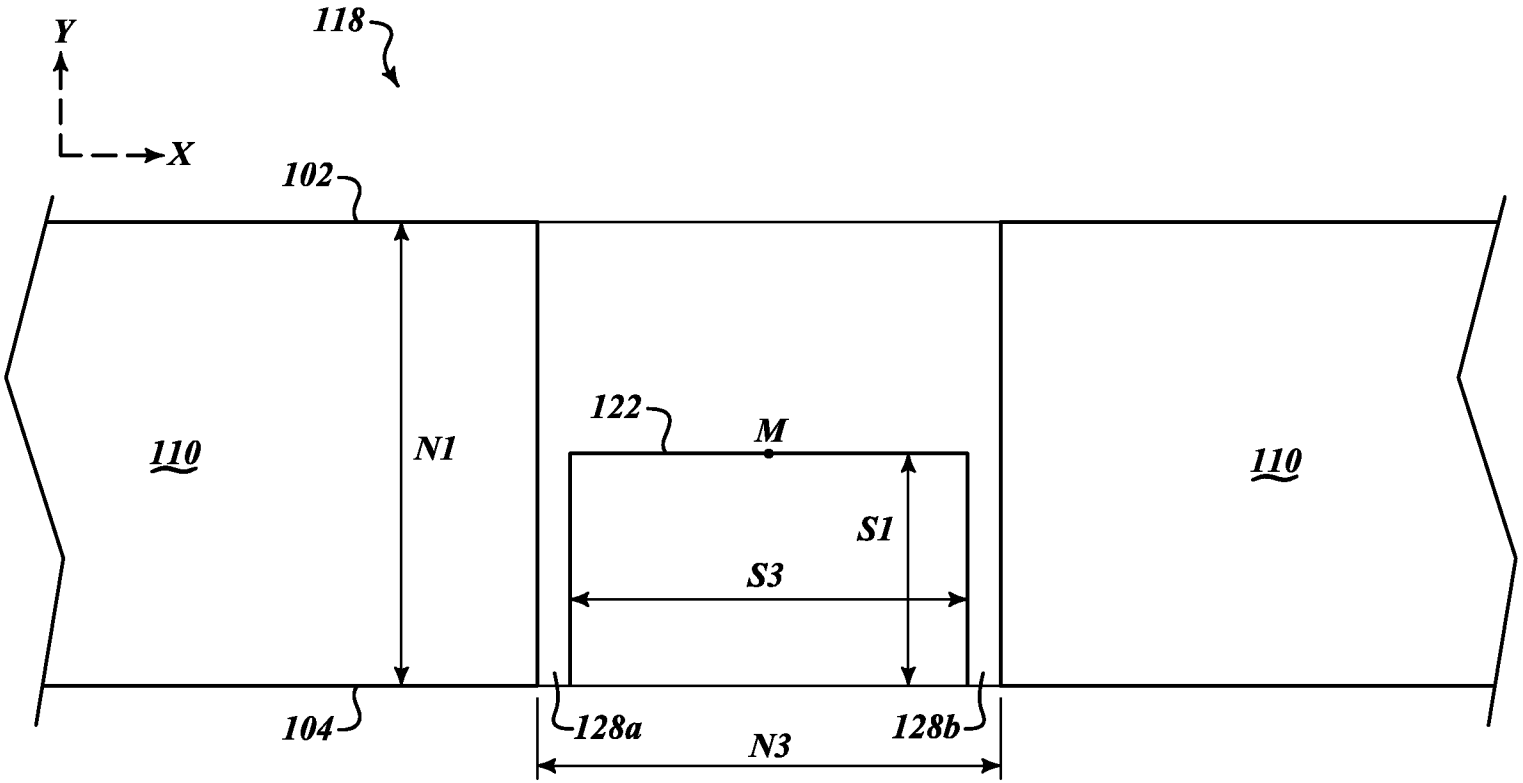
FIG. 11 is a side view of the drainage assembly shown in FIG. 8.

FIGS. 9, 10, and 11 are side views of embodiments of drainage assemblies 118 according to the disclosure from the perspective of the x-axis X and the y-axis Y. As shown, in some embodiments (e.g., FIGS. 10 and 11) the notch width N3 is substantially larger than the slot width S3, thereby creating two transition portions 128 (a first transition portion 128*a* and a second transition portion 128*b*). Referring back to FIG. 7, the transition portions 128 may be substantially curved in some embodiments. Referring back to FIG. 8, the transition portions 128 may be substantially straight and parallel to the x-axis X in other embodiments. In some embodiments (e.g., FIG. 9), the notch width N3 and the slot width S3 are substantially equal and there are no transition portions 128.

Referring again to FIGS. 9, 10, and 11, the notch height N1 may extend from the top surface 102 of the floor panel 100 to the bottom surface 104 of the floor panel 100. In some embodiments, the notch height N1 may extend from the top surface 102 of the floor panel 100, but may not extend completely to the bottom surface 104 of the floor panel 100. Notch heights N1 that extend a point M on the first transverse surface 110 defined by the top of the drainage slot 122. As shown in the FIGS. 9, 10, and 11, the drainage slot 122 may be substantially symmetric about the y-axis Y. In some embodiments, the slot height S1 is approximately half the size of the notch height N1. The disclosure is intended to cover drainage notches 120 having notch heights N1 ranging from approximately 1/16 inches to approximately ¾ inches, depending on the panel thickness P3.

Figure 12:
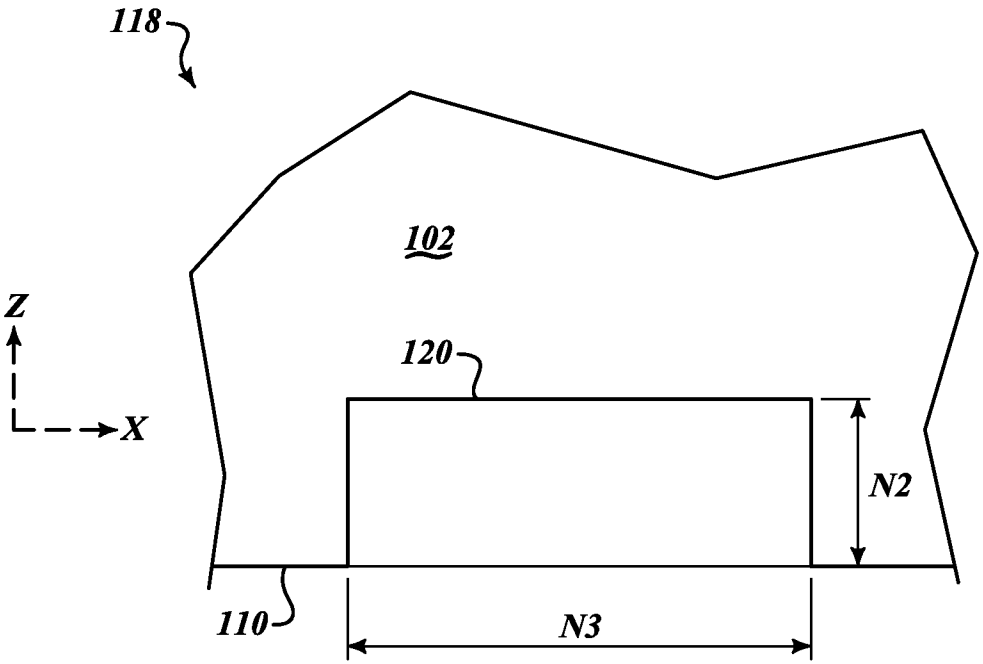
FIG. 12 is a top view of the drainage assembly shown in FIGS. 6, 8, 9 and 11.
Figure 13:
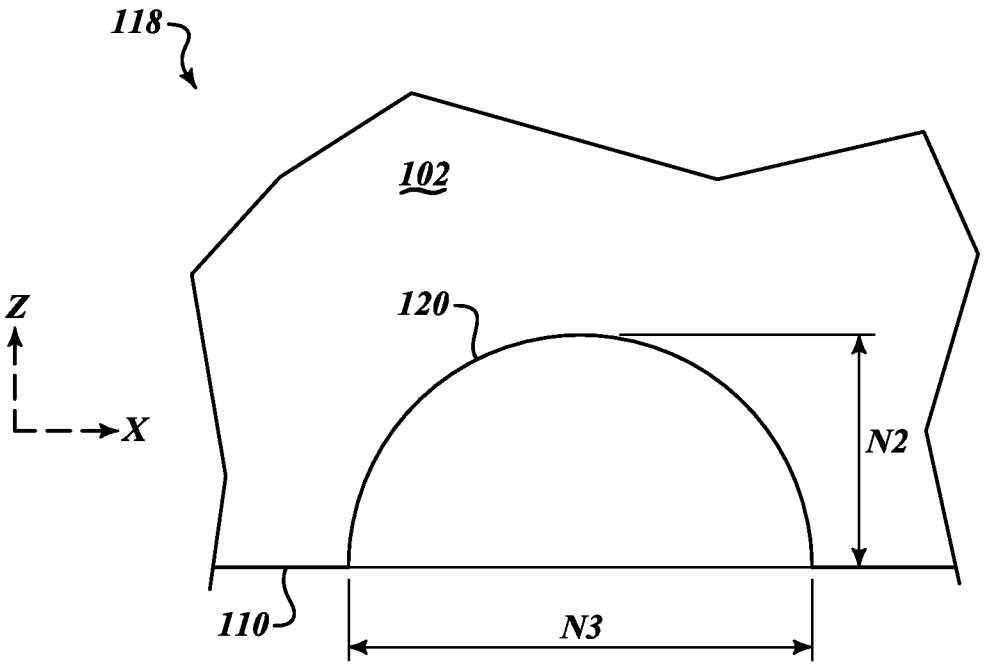
FIG. 13 is a top view of the drainage assembly shown in FIGS. 7 and 10.

FIGS. 12 and 13 are top views of embodiments of drainage assemblies 118 according to the disclosure from the perspective of the x-axis X and the z-axis Z. FIG. 12 is a top view of the drainage assembly 118 shown in FIGS. 6, 8, 9 and 11; and FIG. 13 is a top view of the drainage assembly 118 shown in FIGS. 7 and 10. Accordingly, only the drainage notch 120 (not the drainage slot 122) is visible as this perspective is from the top surface 102 of the floor panel 104. In FIG. 12, the drainage notch 120 has a substantially rectangular profile. In FIG. 13, the drainage notch 120 has a substantially semi-circular profile. In other embodiments, drainage notches 120 may have any other profile that would be suitable to a person or ordinary skill in the art for facilitating entry of water into the one or more drainage slots 122. Drainage notches 120 according to embodiments of the disclosure may be substantially symmetric about the z-axis Z and may have a notch width N3 ranging anywhere from approximately ⅛ inches to approximately 3 inches.

Figure 14:
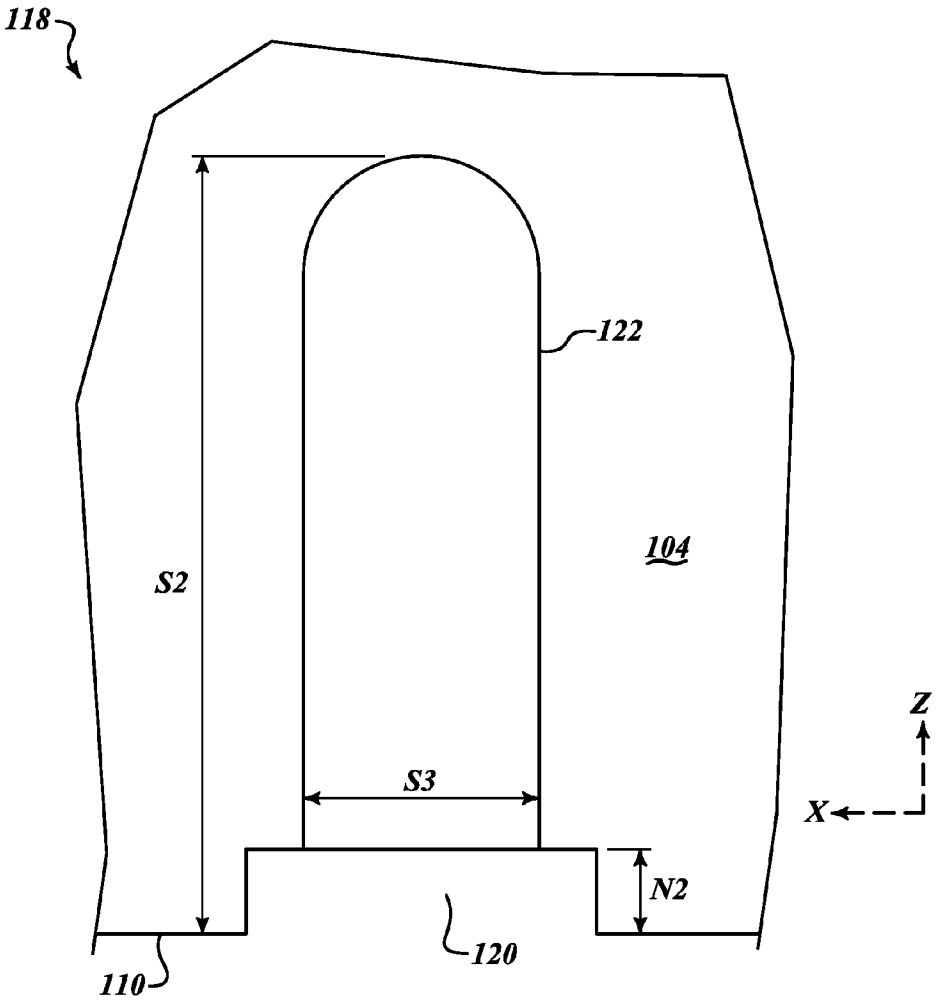
FIG. 14 is a bottom view of the drainage assembly shown in FIGS. 6, 9, and 12.
Figure 15:
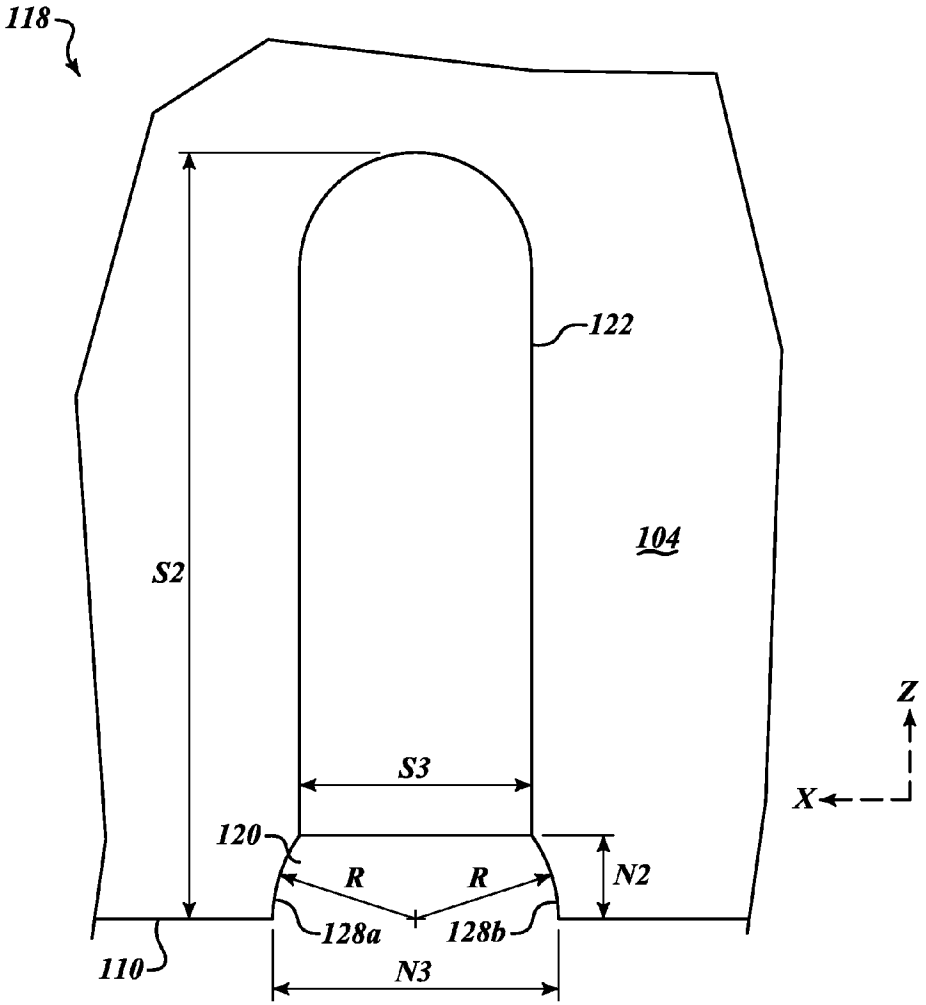
FIG. 15 is a bottom view of the drainage assembly shown in FIGS. 7, 10, and 13.
Figure 16:
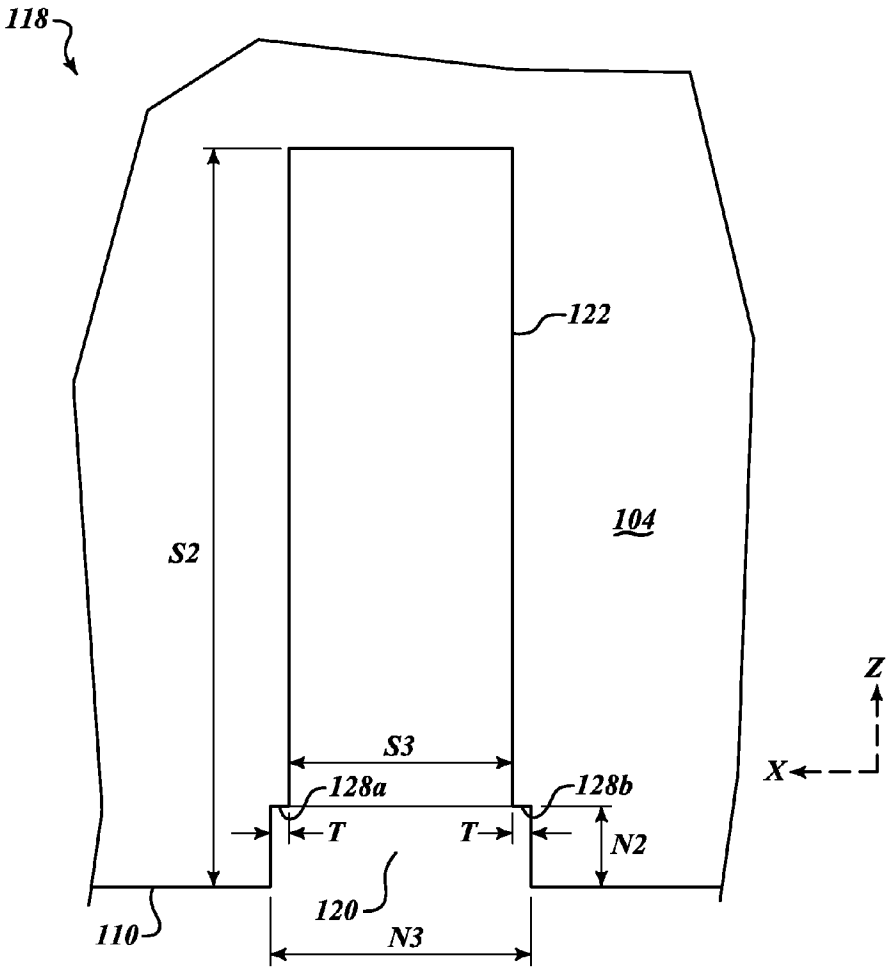
FIG. 16 is a bottom view of the drainage assembly shown in FIGS. 8, 11, and 12.
Figure 17:
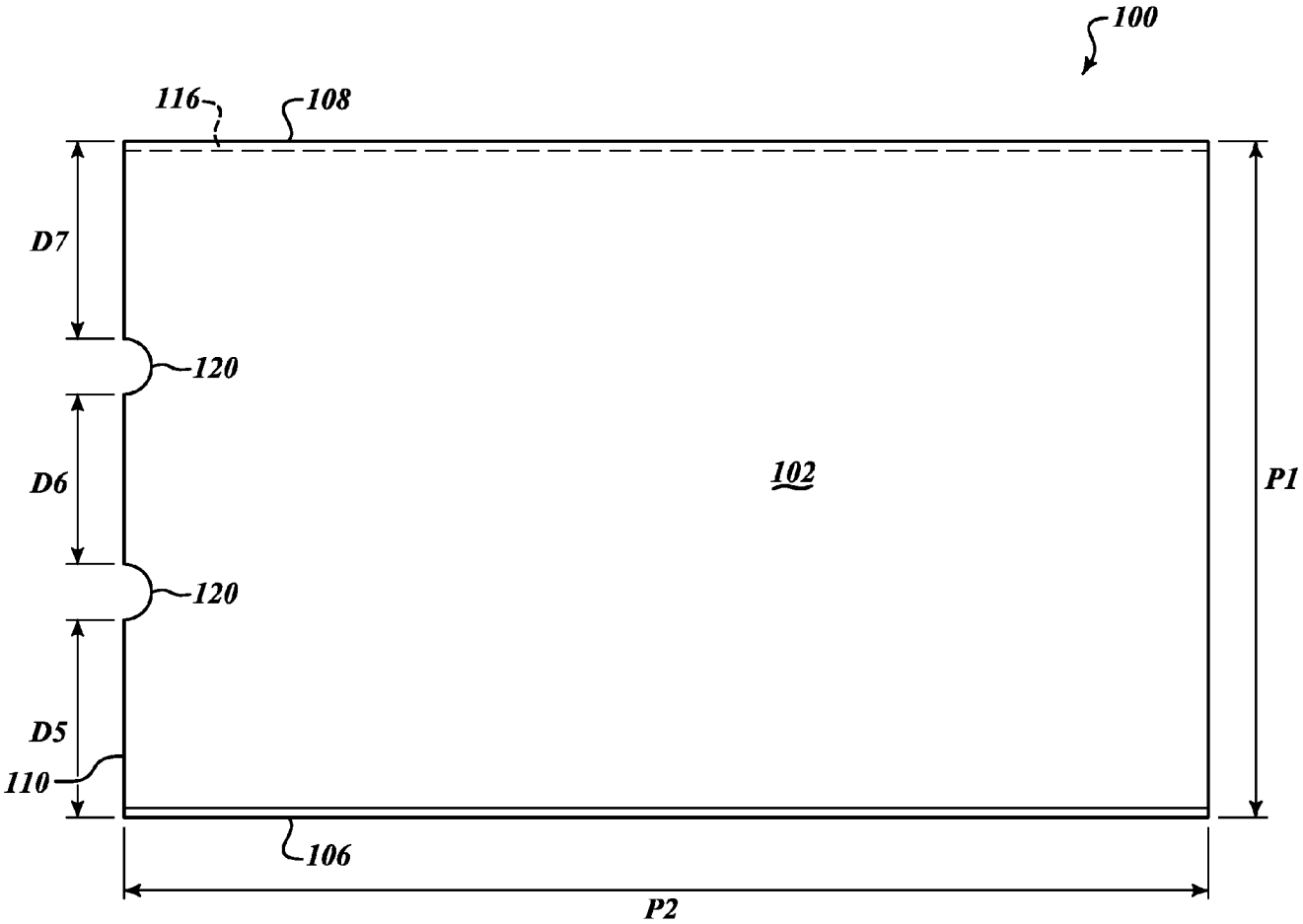
FIG. 17 is a top plan view of another floor panel according to embodiments of the disclosure.
Figure 18:
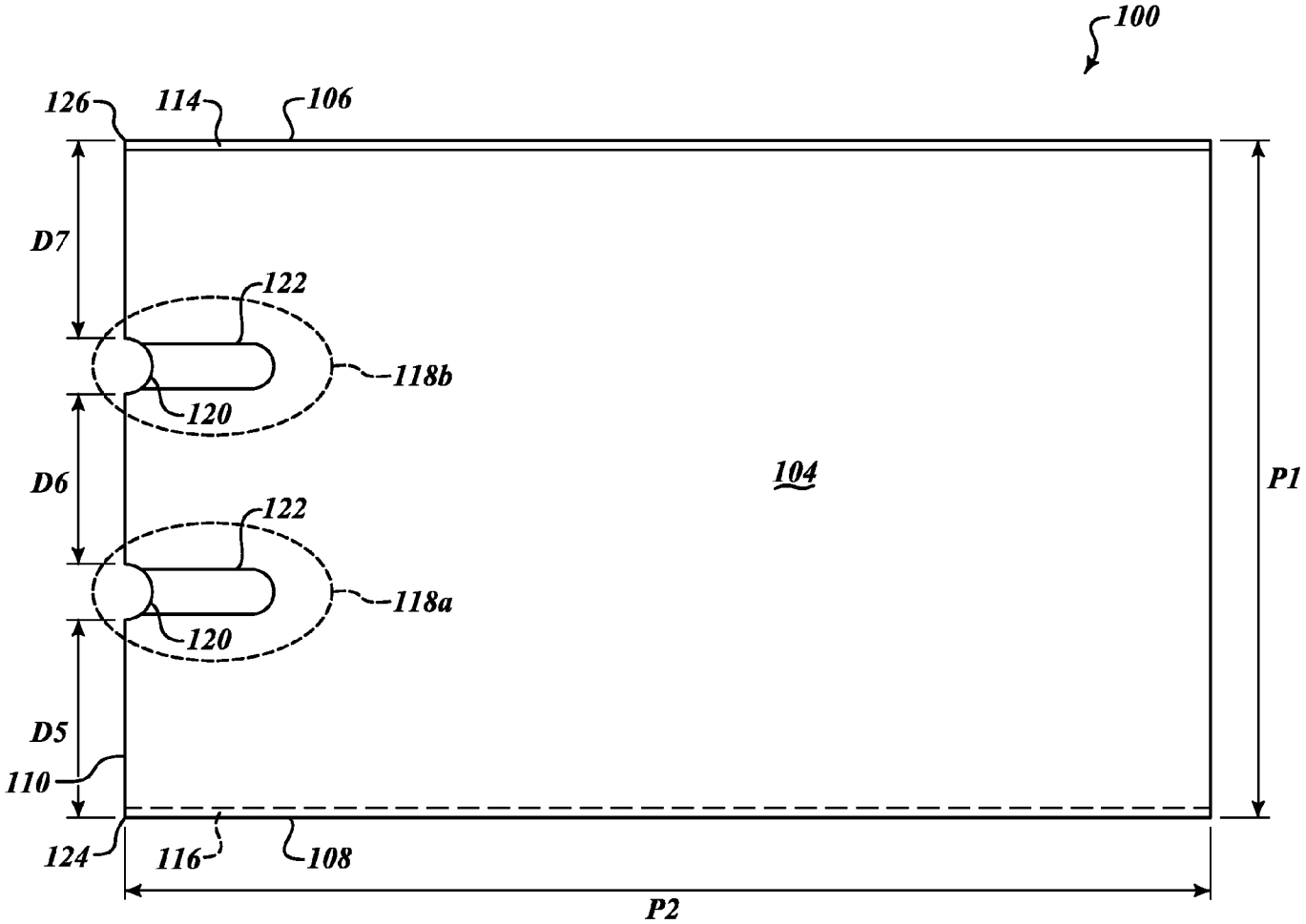
FIG. 18 is a bottom plan view of the floor panel shown in FIG. 16.

FIGS. 14, 15, and 16 are bottom views of embodiments of drainage assemblies 118 according to the disclosure from the perspective of the x-axis X and the z-axis Z. In FIGS. 15 and 16, the first transition portion 128*a* and the second transition portion 128*b* are visible. In FIG. 15, the transition portions 128 are configured so that a radius R measures approximately 1/16 of an inch to approximately 1/4 of an inch. In FIG. 16, the transition portions 128 having a transition portion width T that ranges from approximately 1/8 of an inch to approximately 1/4 of an inch. The disclosure is intended to cover drainage slots 122 having slot depths S2 ranging from approximately 3/4 inches to approximately 3 inches. Drainage notches 120 according to embodiments of the disclosure have notch depths N2 of less than approximately 1/2 inches.

As discussed above, embodiments of the disclosure are not limited to floor panels having exactly three drainage assemblies. Floor panels according to embodiments of the disclosure may have any number of drainage assemblies. As a non-limiting example, in FIGS. 16 and 17, top and bottom plan views are shown of a floor panel 100 having two drainage assemblies 118 (first drainage assembly 118*a* and second drainage assembly 118*b*). In some embodiments, the drainage assemblies 118 may be arranged so that the spacing between each of the drainage assemblies 118 (D5, D6, and D7) is substantially equal. In other embodiments, the first drainage assembly 118*a* may be located approximately 13 inches from the first end 124 of the first transverse surface 110 and the second drainage assembly 118*b* may be located approximately 13 inches from the second end 126 of the first transverse surface 110. Accordingly, in some embodiments, D5 is approximately 13 inches, D6 is approximately 26 inches, and D7 is approximately 13 inches. A person of ordinary skill in the art will appreciate that the above-mentioned dimensions may change based on the size of the drainage assembles 118 and that any suitable number and configuration of drainage assemblies 118 is envisioned as part of the disclosure.

Figure 19:
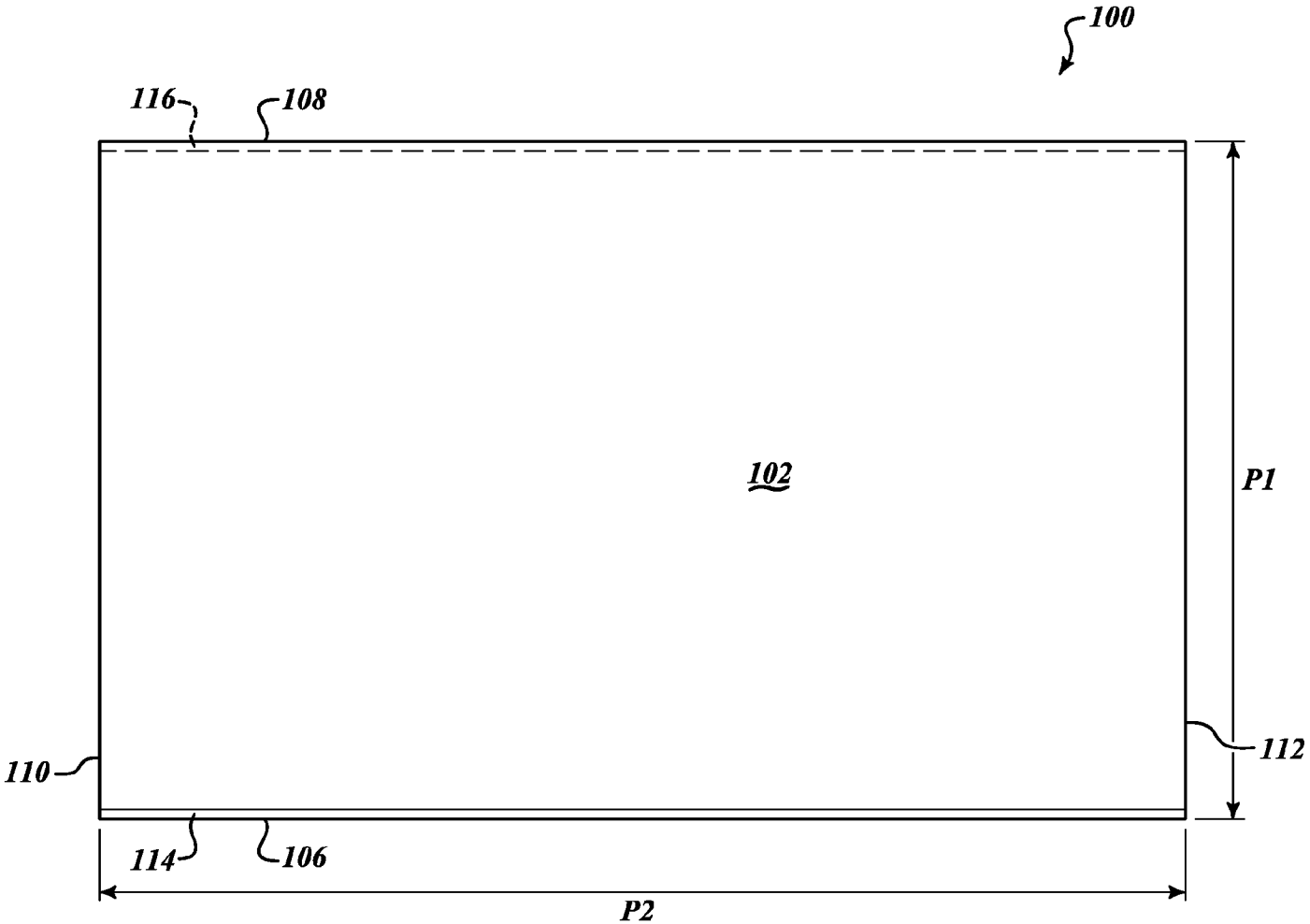
FIG. 19 is a top plan view of yet another floor panel according to embodiments of the disclosure.
Figure 20:
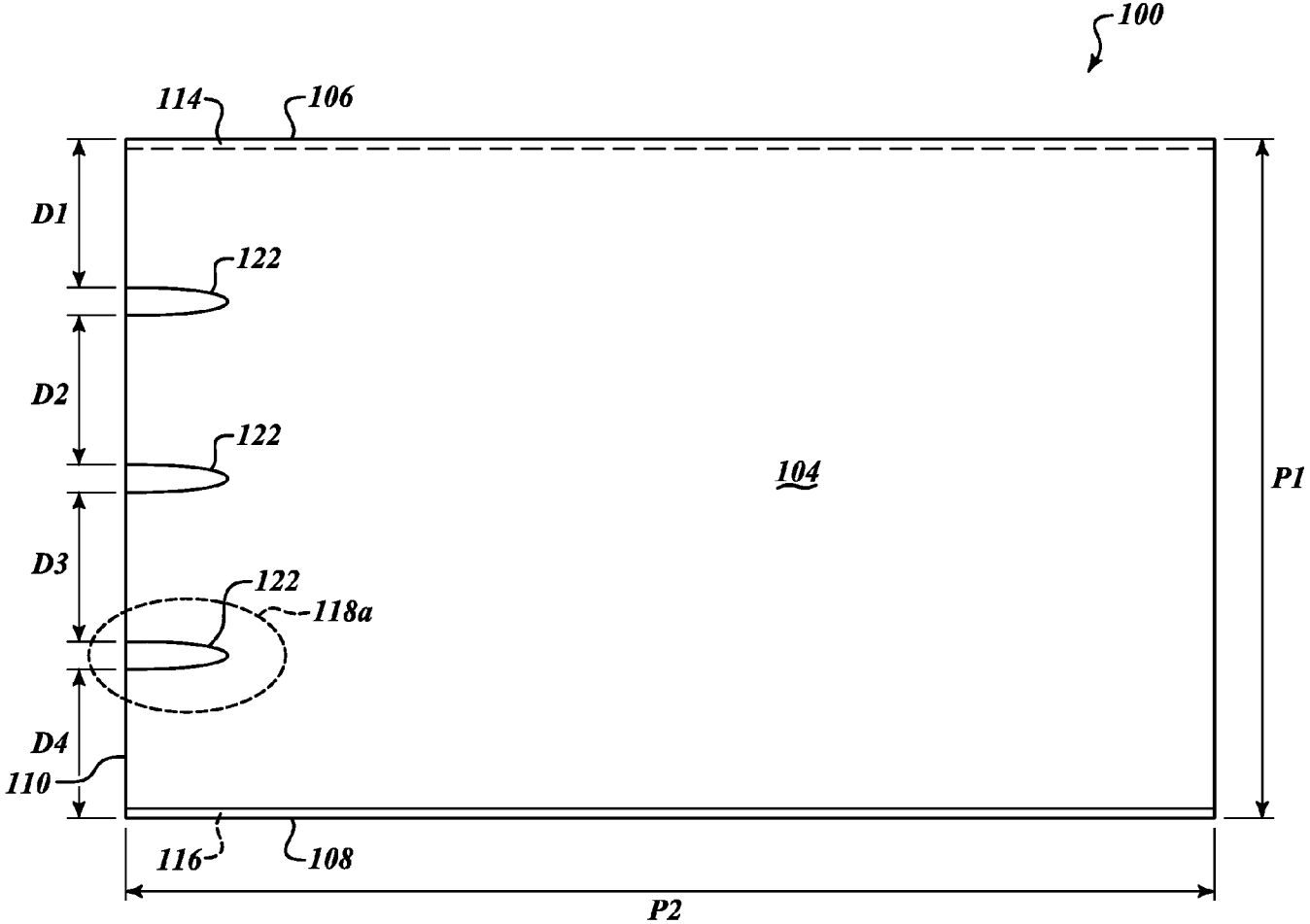
FIG. 20 is a bottom plan view of the floor panel shown in FIG. 18.
Figure 21:
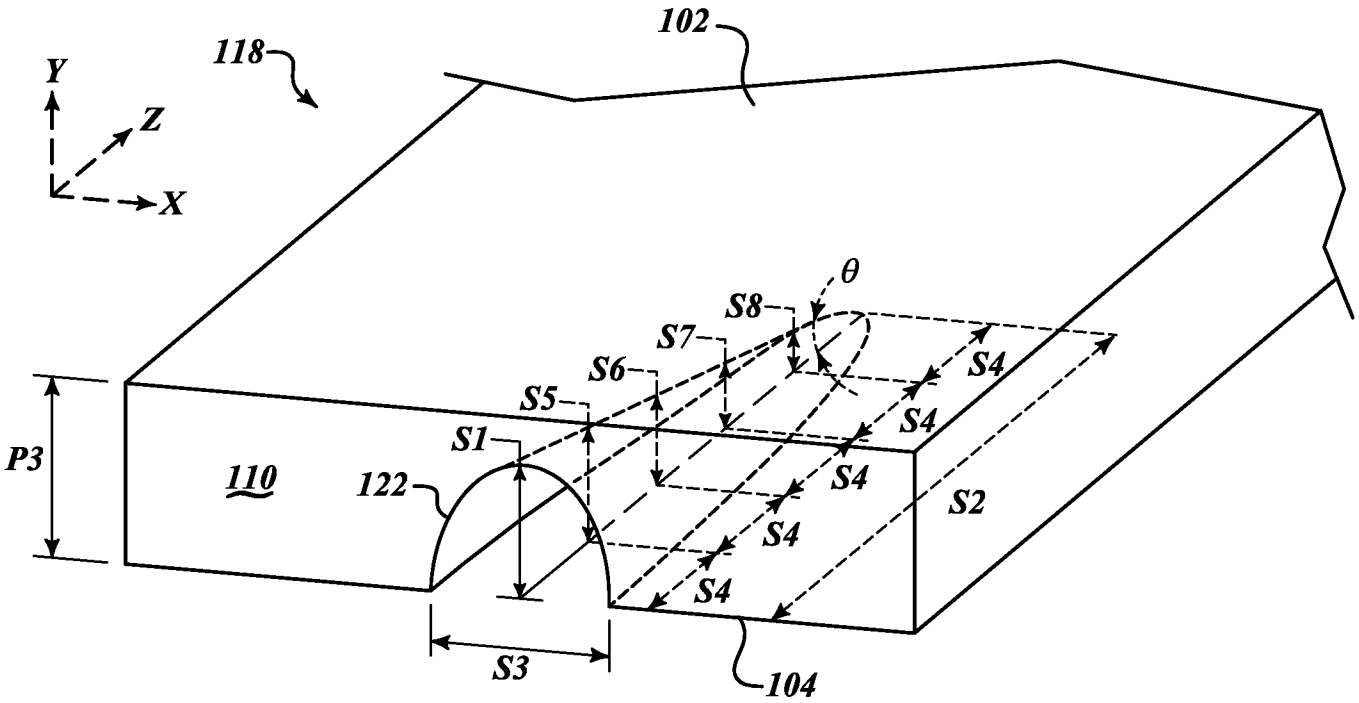
FIG. 21 is a perspective view of yet another embodiment of a drainage assembly according to the disclosure.

In some embodiments, floor panels according to the disclosure may have drainage assemblies comprising one or more drainage slots, but no drainage notches. As a non-limiting example, FIGS. 19 and 20 depict top and bottom plan views of a floor panel 100 having drainage assemblies 118 comprising only drainage slots 122. In FIG. 21, a perspective view of one of the drainage assemblies from FIGS. 19 and 20 is shown in further detail. In this embodiment, a tapered drainage slot 122 having a generally arched, rounded, or cylindrical shape is depicted. As shown, the height S1 gradually decreases. Each interval S4 represents about 1/2 of an inch. The slot depth S2 is about 2 1/2 inches. Accordingly, S5 is about 0.5 inches, S6 is about 0.495 inches, S7 is about 0.438 inches, and S8 is about 0.340 inches. A taper angle θ may therefore be about 2 degrees to about 15 degrees. Additionally, the drainage slot 122 shown in FIG. 21 may also have any of the features attributed to embodiments of drainage slots 122 described in this disclosure.

Figure 22:
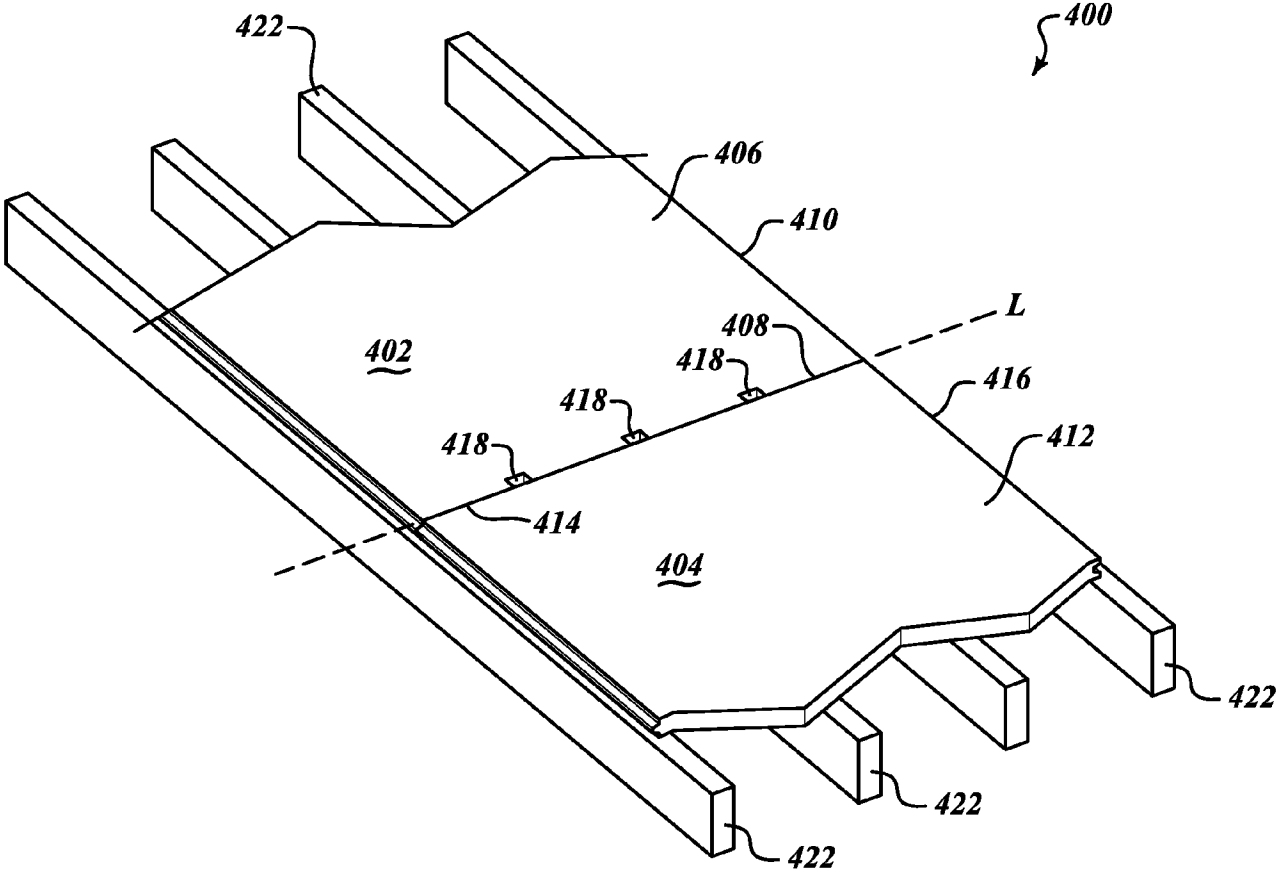
FIGS. 22 and 23 are perspective views of two floor panels according to the disclosure connected to form part of a flooring system.
Figure 23:
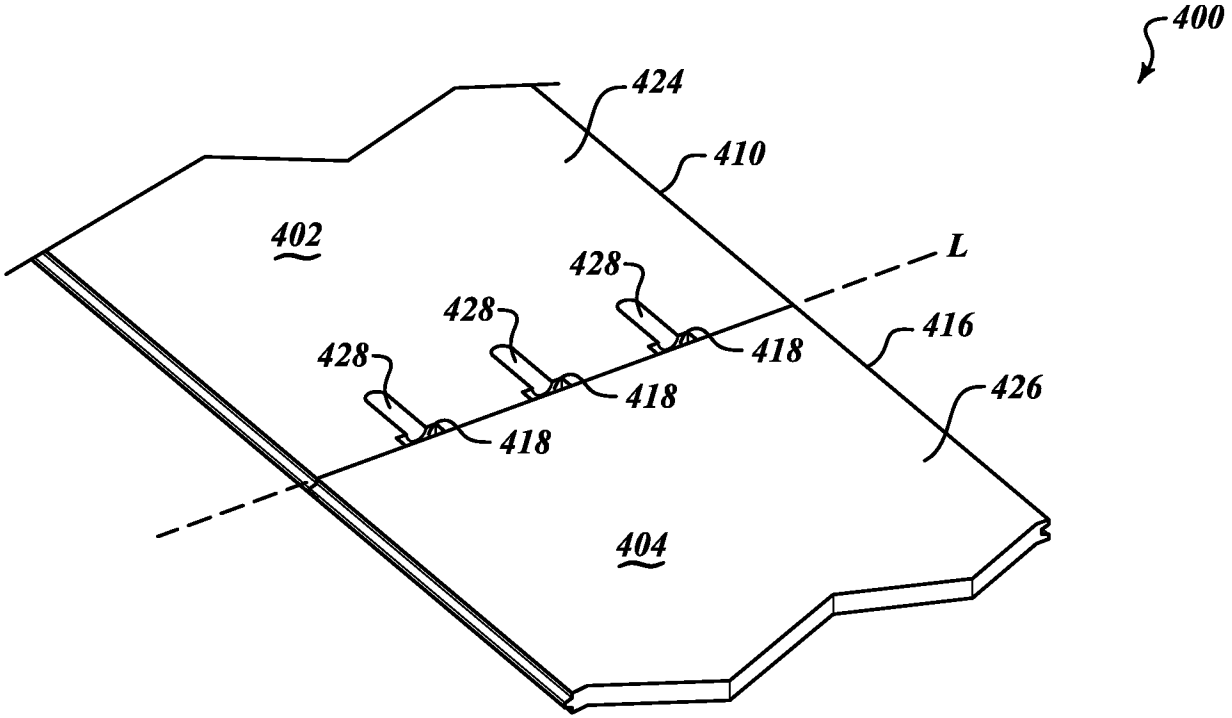

Further aspects of the disclosure include flooring drainage systems comprising two or more interconnected floor panels. In some embodiments, the floor panels may be interconnected so that there is an approximately 1/8 inch gap between each panel on the transverse surfaces. In other embodiments, no gaps are present. Further, some panel configurations may include gaps and others may not. FIGS. 22 and 23 are perspective views of a flooring drainage system 400 including two floor panels (a first floor panel 402 and a second floor panel 404) mounted together on a plurality of floor joists 422. The first floor panel 402 includes a first top surface 406, a first panel first transverse surface 408, a first panel first longitudinal surface 410, and a first bottom surface 424. The second floor panel 404 includes a second top surface 412, a second panel transverse surface 414, a second panel longitudinal surface 416, and a second bottom surface 426. Referring back to FIGS. 4 and 5, the first floor panel 402 and the second floor panel 404 have tongue portions and groove portions that are not visible in the configuration depicted.

As shown in FIG. 22, the first floor panel 402 may include one or more first drainage notches 418 arranged on the first panel first transverse surface 408. In some embodiments, the first floor panel 402 has a first panel second transverse surface (not shown) having no notches or slots. In some embodiments, the second floor panel 404 may have no notches or slots on the second panel first transverse surface 414. In some embodiments, the second floor panel 404 may a second panel second transverse surface (not shown) having notches and/or slots according to embodiments of the disclosure. As shown in FIG. 23, the first floor panel 402 may include one or more first drainage slots 428 on the first bottom surface 424.

Floor joists according to the disclosure may be I-joists, floor trusses, traditional floor joists (e.g., a solid sawn piece of lumber), or any type of structural flooring support known to a person of ordinary skill in the art. The first floor panel 402 and the second floor panel 404 may span several floor joists 422. Further, the first floor panel 402 and the second floor panel 404 may be oriented on the floor joists 422 such that the first drainage notches 418 and the first drainage slots 428 are located along a floor joist 422.

In FIG. 22, the first floor panel 402 and the second floor panel 404 are shown arranged so that the first drainage notches 418 are substantially symmetric about a line L defined by the meeting of the first panel transverse surface 408 and the second panel transverse surface 414. The first floor panel 402 and the second floor panel 404 are shown arranged so that the first drainage slots 428 create openings defined the second panel first transverse surface 414 and the first drainage slots 428. In other embodiments, the first floor panel 402 and the second floor panel 404 may be arranged in any other configuration to facilitate water to flow from the first top surface 406 and the second top surface 412 to the first bottom surface 424 and the second bottom surface 426 through the one or more drainage slots and/or notches. A person of ordinary skill in the art will appreciate that there are many other ways in which drainage assemblies according to embodiments of the disclosure can be arrange to form flooring drainage systems.

Figure 24:
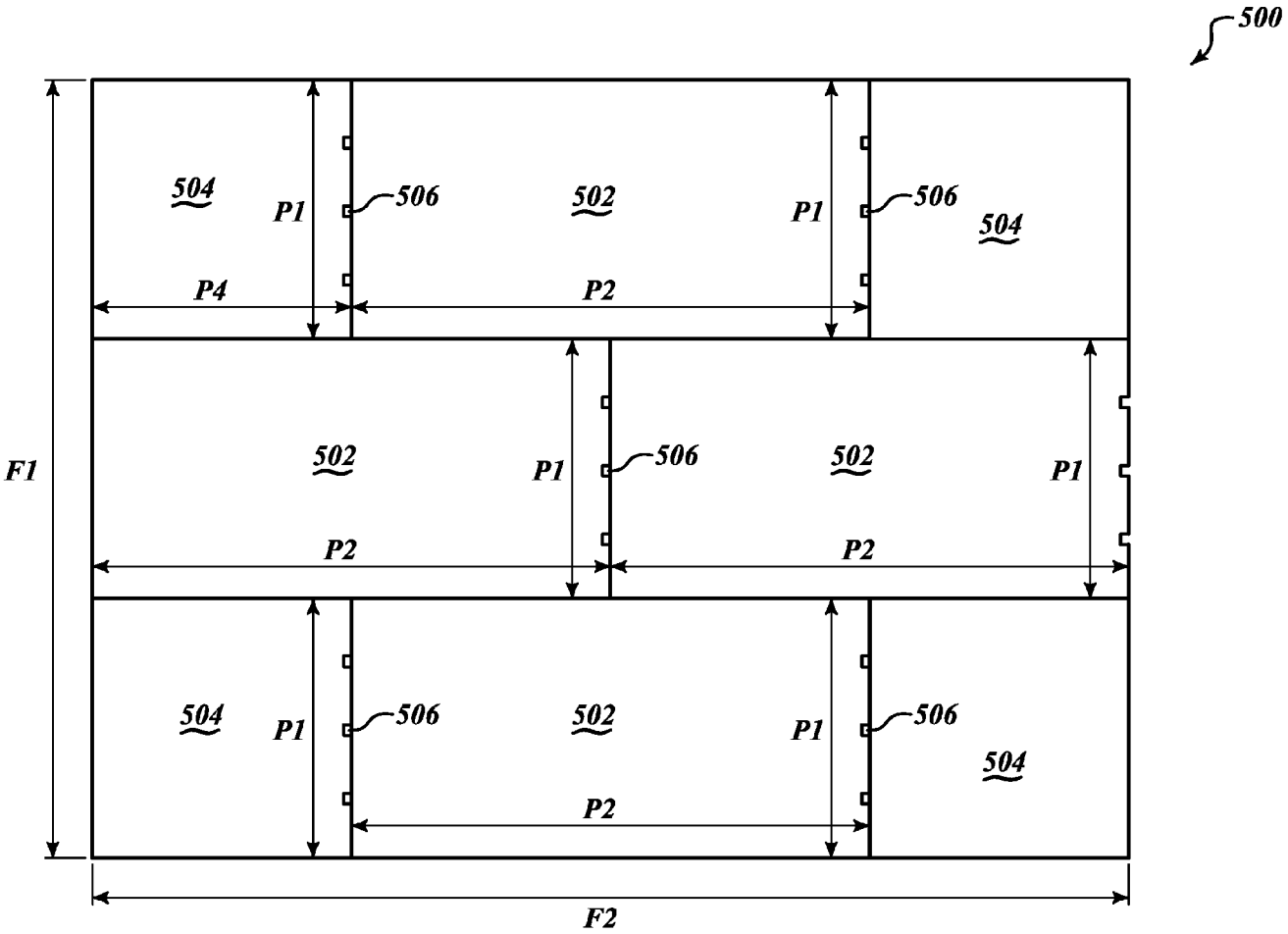
FIG. 24 is a top plan view of an embodiment of a flooring drainage system constructed from interconnected floor panels according to embodiments of the disclosure.
Figure 25:
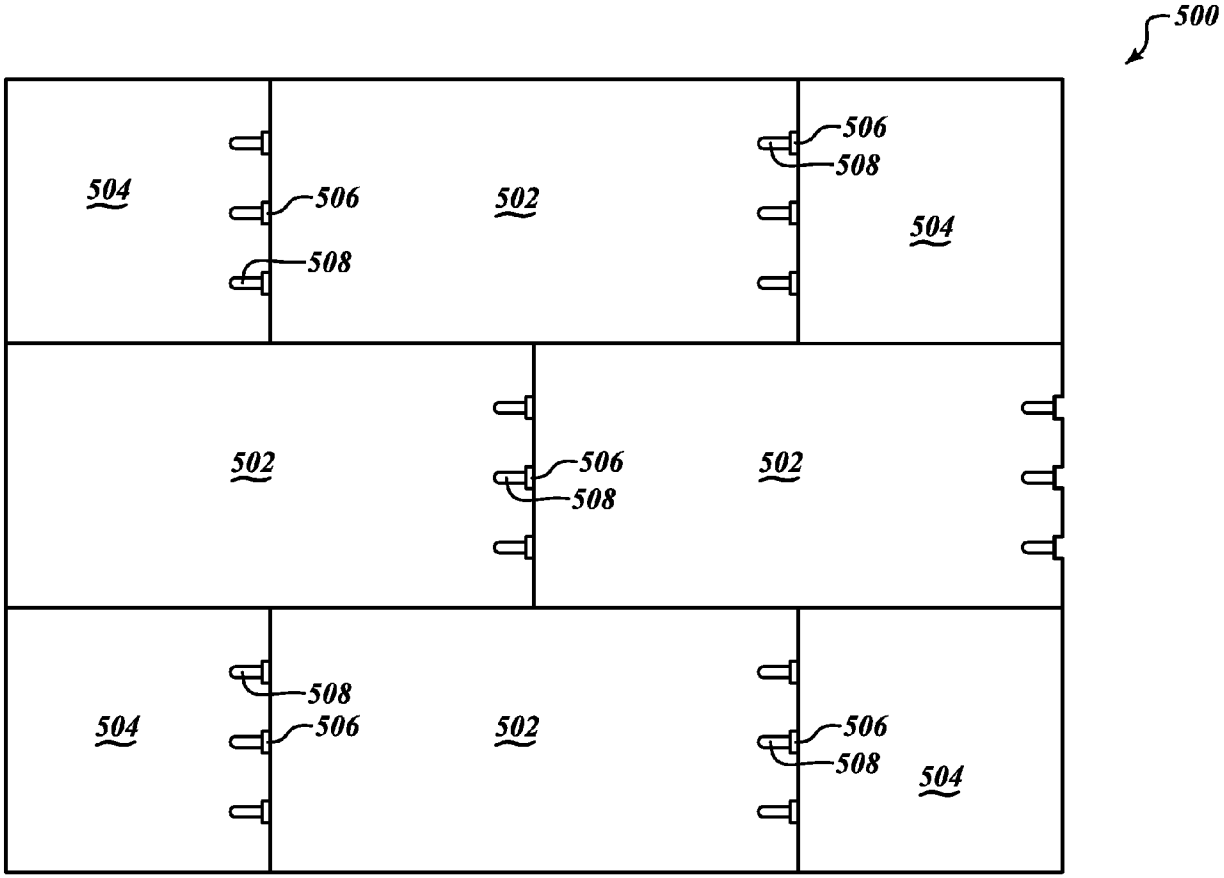
FIG. 25 is a bottom plan view of the flooring drainage system from FIG. 24.

In some embodiments, floor panels according to embodiments of the disclosure having varied dimensions may be arranged in a staggered fashion to form a flooring drainage system. In FIGS. 24 and 25, top and bottom plan views of a flooring drainage system 500 including one or more long floor panels 502 and one or more short floor panels 504 that are interconnected and oriented on floor joists (not shown). The long floor panels 502 may have the dimensions P1, P2, and P3 disclosed and illustrated. The short floor panels 504 may have the dimensions P1, P4, and P3 disclosed above and illustrated in FIGS. 24 and 25. P4 may be approximately one half the size of P2. Referring back to FIGS. 4 and 5, each of the floor panels shown has a tongue portion and a groove portion (not visible in the Figure) and the floor panels are interconnected so that the tongue portion of one panel corresponds to the groove portion of another panel. Accordingly, the entire flooring drainage system may have a flooring system width F1 of approximately 12 feet and a flooring system length F2 of approximately 16 feet. A person of ordinary skill in the art will appreciate that flooring systems having dimensions other than those explicitly disclosed are envisioned to be within the scope of the disclosure.

In the embodiments shown in FIGS. 24 and 25, the long floor panels 502 and the short floor panels 504 each include one or more drainage assemblies. Although the drainage assemblies may include any embodiment disclosed, for the purposes of illustration, the long floor panels 502 and the short floor panels 504 each include one or more drainage notches 506 and one or more drainage slots 508. In other embodiments, the long floor panels 502 and the short floor panels 504 may feature different embodiments of drainage assemblies according to the disclosure.

Figure 26:
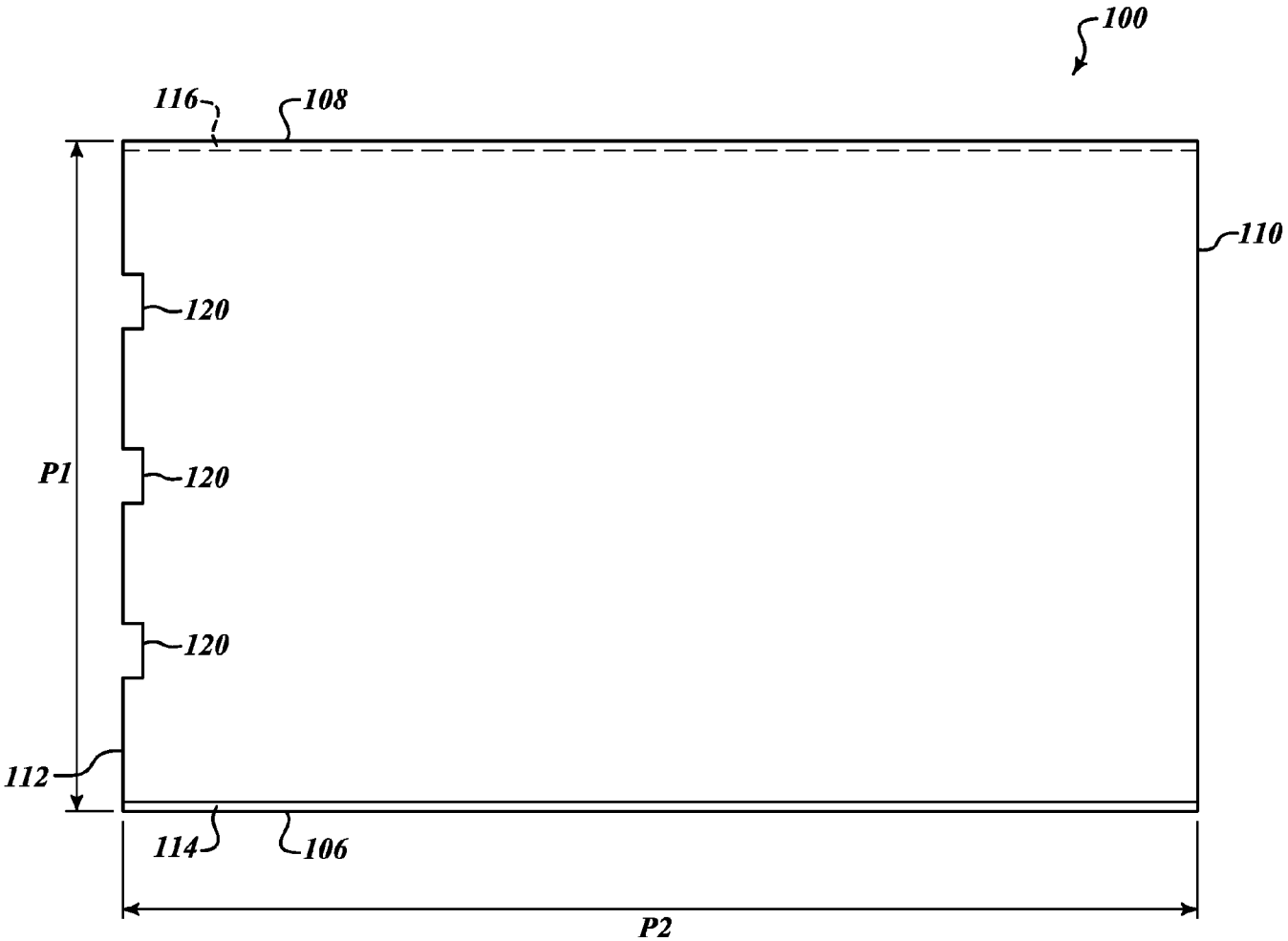
FIG. 26 is a top plan view of yet another floor panel according to embodiments of the disclosure.
Figure 27:
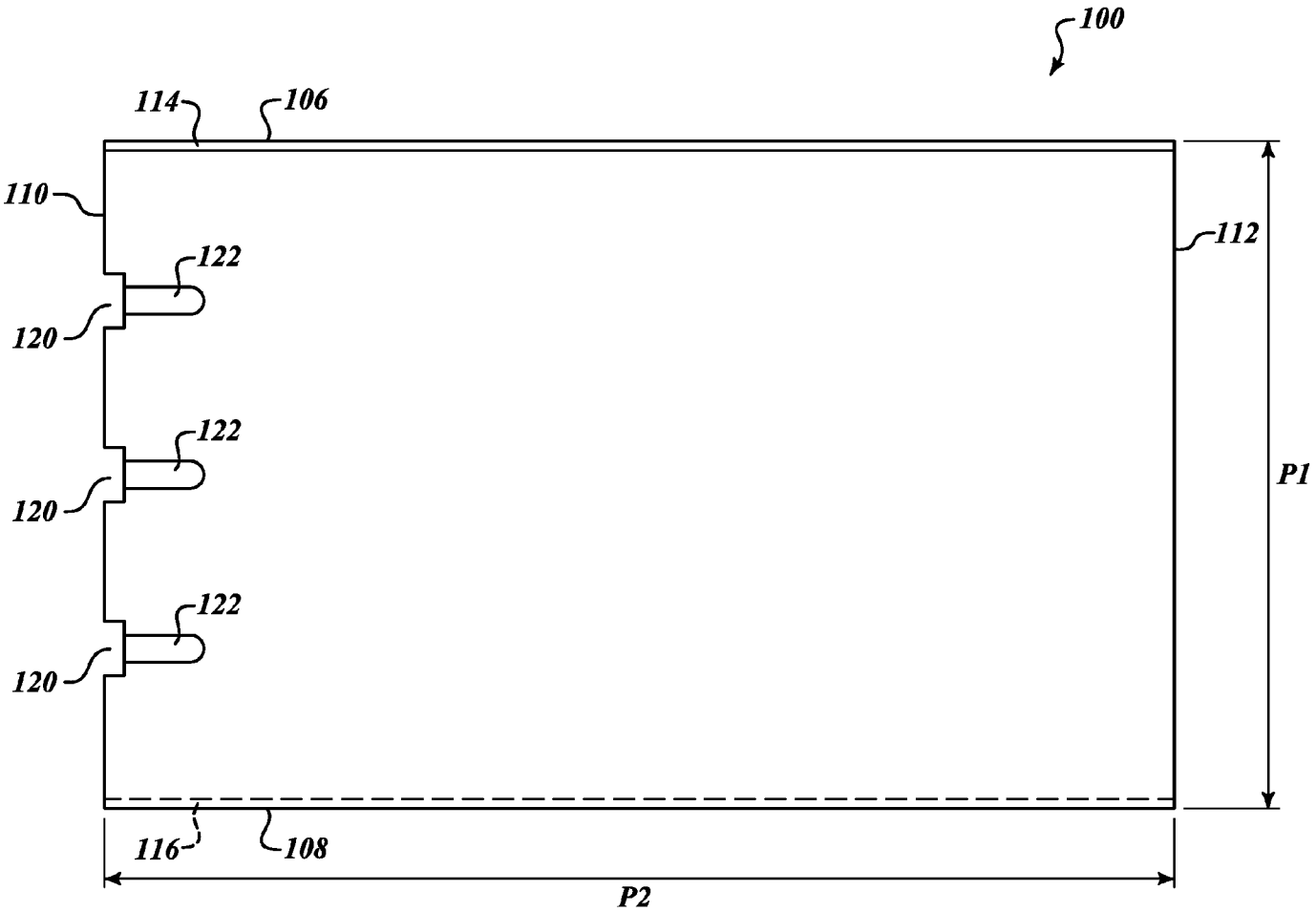
FIG. 27 is a bottom plan view of the floor panel shown in FIG. 26.

In some embodiments, floor panels according to the disclosure may include drainage assemblies featuring notches on one side of the panel and slots on the other side of the panel. Referring to FIGS. 26 and 27, top and bottom plan views of a floor panel 100 are shown having one or more drainage notches 120 located on the second transverse surface 112 (e.g., FIG. 26) and one or more drainage slots 122 located on the first transverse surface 110 (e.g., FIG. 27). In some embodiments, the drainage notches 120 could be located on the first transverse surface 110 and the drainage slots 122 could be located on the second transverse surface 112.

Figure 28:
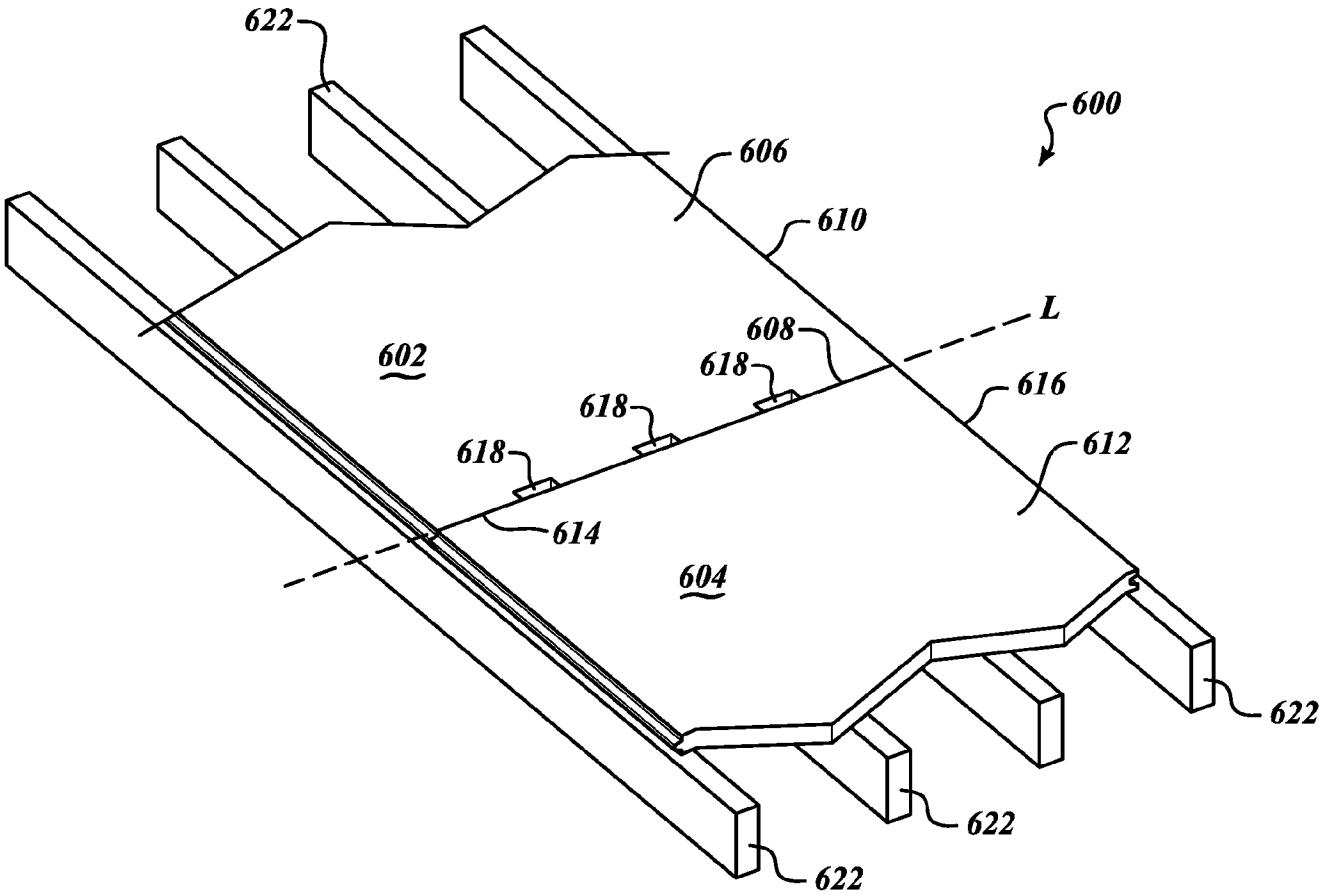
FIGS. 28 and 29 are perspective views of two floor panels according to the disclosure connected to form part of a flooring system.
Figure 29:
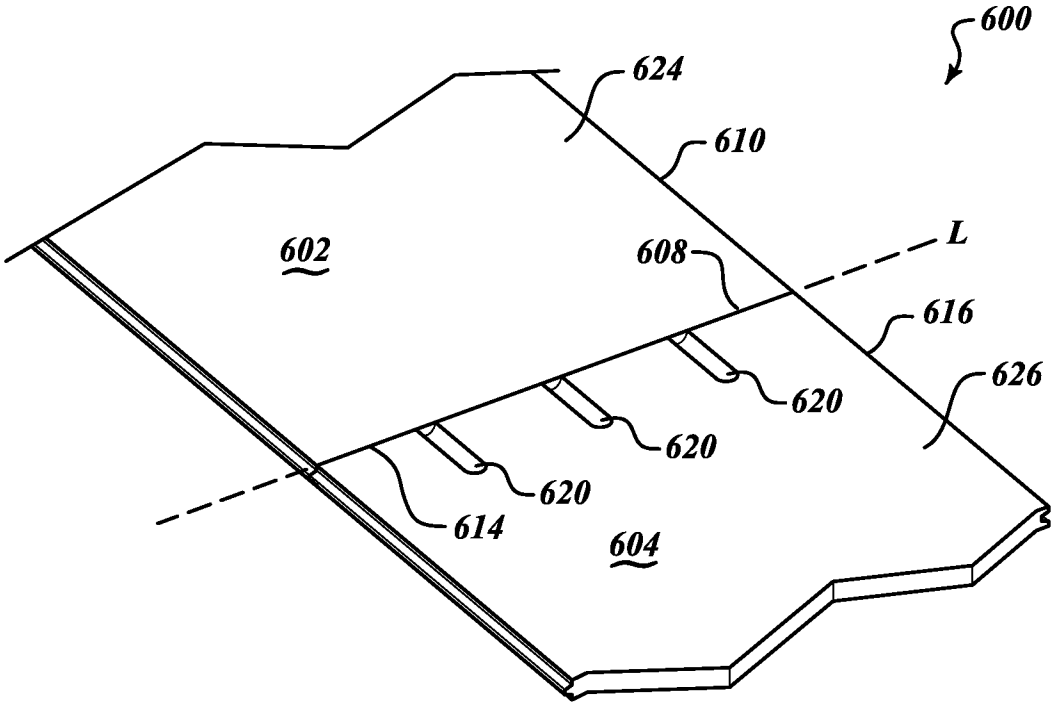

FIGS. 28 and 29 are perspective Figures views of a flooring drainage system 600 including two floor panels according to the embodiment depicted in FIGS. 26 and 27 (a first floor panel 602 and a second floor panel 604) mounted together on a plurality of floor joists 622. The first floor panel 602 includes a first top surface 606, a first panel transverse surface 608, a first panel longitudinal surface 610, and a first bottom surface 624. The second floor panel 604 includes a second top surface 612, a second panel transverse surface 614, a second panel longitudinal surface 616, and a second bottom surface 626. Referring back to FIGS. 4 and 5, the first floor panel 602 and the second floor panel 604 have tongue portions and groove portions that are not visible in the configuration depicted.

As shown in FIG. 28, the first floor panel 602 may include one or more drainage notches 618 arranged on the first panel transverse surface 608. As shown in FIG. 29, the second floor panel 604 may include one or more second drainage slots 620 arranged on the second panel transverse surface 614. The first floor panel 602 and the second floor panel 604 may be connected so that the drainage notches 618 on the first panel 602 are on substantially the same position on line L as the drainage slots 620 on the second floor panel 604. In other embodiments, the first floor panel 602 and the second floor panel 604 may be arranged in any other configuration to facilitate water to flow from the first top surface 606 and the second top surface 612 to the first bottom surface 624 and the second bottom surface 626 through the one or more drainage slots and/or notches.

Figure 30:
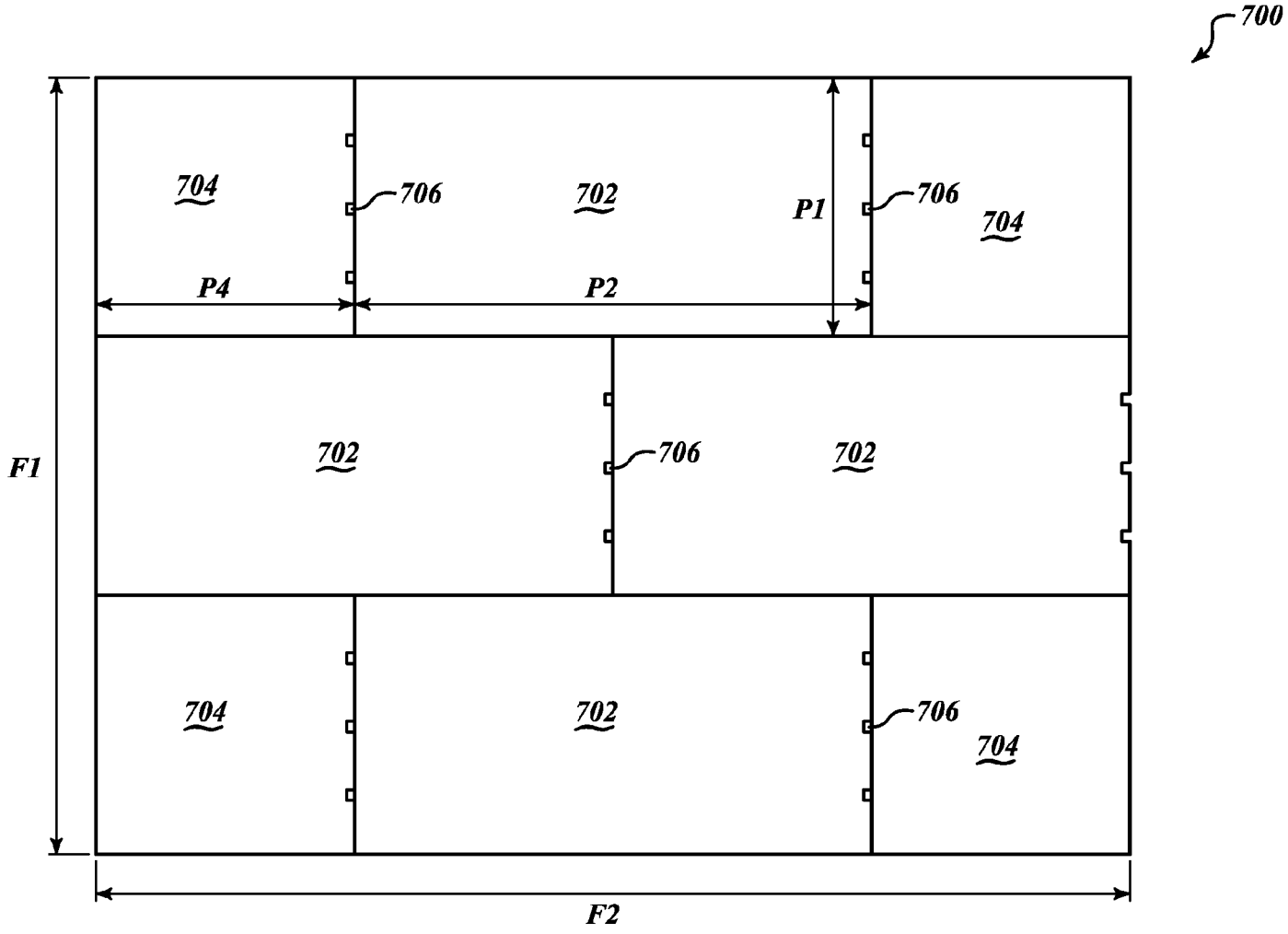
FIG. 30 is a top plan view of another embodiment of a flooring drainage system constructed from interconnected floor panels according to embodiments of the disclosure.
Figure 31:
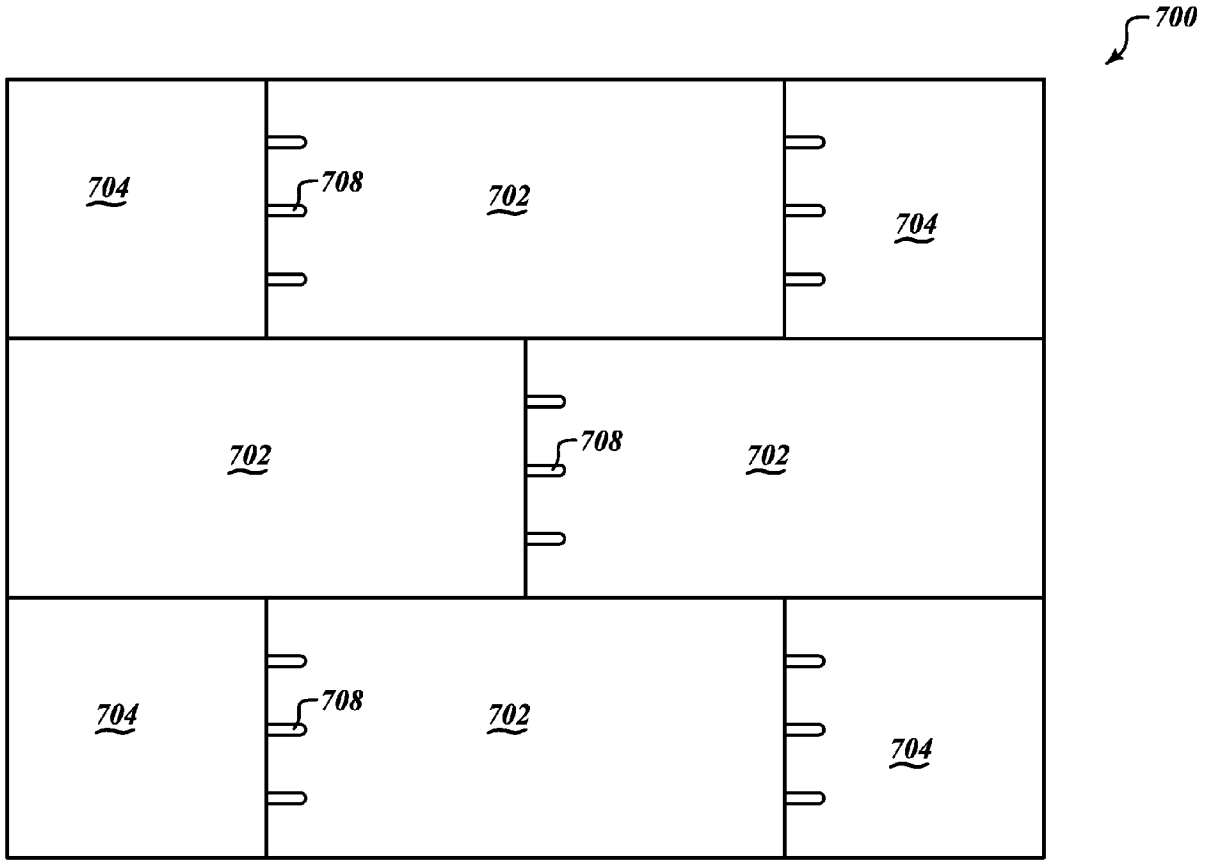
FIG. 31 is a bottom plan view of the flooring drainage system shown in FIG. 30.

Floor panels having features of the embodiments disclosed in FIGS. 26-29 may also be arranged in a staggered fashion (as depicted in FIGS. 24 and 25 above) to form a flooring drainage system. In FIGS. 30 and 31, top and bottom plan views of a flooring drainage system 700 including one or more long floor panels 702 and one or more short floor panels 704 may be interconnected and oriented on floor joists (not shown). The long floor panels 702 may have the dimensions P1, P2, and P3 disclosed and illustrated. The short floor panels 704 may have the dimensions P1, P4, and P3 disclosed above and illustrated in the Figure. Referring back to FIGS. 4 and 5, each of the floor panels shown has a tongue portion and a groove portion (not visible in the Figure) and the floor panels are interconnected so that the tongue portion of one panel corresponds to the groove portion of another panel.

While the flooring systems illustrated in FIGS. 22-25 and 29-31 depict construction involving a specific number of flooring panels, it should be appreciated that constructing a flooring system with fewer or more flooring panels than those explicitly shown is also within the scope of the present disclosure. Accordingly, flooring systems according to embodiments of the disclosure may have greater or smaller dimensions (F1 and F2) than those explicitly depicted. Further, floor panels according to embodiments of the disclosure may be arranged in configurations that are not explicitly shown in the Figures but that would be known to a person of ordinary skill in the art.

Words in the above disclosure using the singular or plural number may also include the plural or singular number, respectively. For example, "floor panel" could also apply to "floor panels." "Drainage assembly" could also apply to "drainage assemblies." Additionally, the words "herein," "above," "below" and words of similar import, when used in this application, shall refer to this application as a whole and not to any particular portions of this application.

From the foregoing, it will be appreciated that the specific embodiments of the disclosure have been described herein for purposes of illustration, but that various modifications may be made without deviating from the disclosure. For example, the dimensions of floor panels according to embodiments of the disclosure may be modified to comply with innovations in the construction industry. Additionally, the placement of drainage assemblies and shape of the respective notches and/or slots may be modified in a manner that would be obvious to a person or ordinary skill in the art.

Aspects of the disclosure described in the context of particular embodiments may be combined or eliminated in other embodiments. For example, features of drainage assemblies described in 6, 7, 9, 10, 13, 14, and 15, Figures may be combined or eliminated with features of drainage assemblies described in FIGS. 8, 11, and 16. Further, while advantages associated with certain embodiments of the disclosure may have been described in the context of those embodiments, other embodiments may also exhibit such advantages, and not all embodiments need necessarily exhibit such advantages to fall within the scope of the disclosure. Accordingly, the invention is not limited except as by the appended claims.

The following examples will serve to illustrate aspects of the present disclosure. The examples are intended only as a means of illustration and should not be construed to limit the scope of the disclosure in any way. Those skilled in the art will recognize many variations that may be made without departing from the spirit of the disclosure.

EXAMPLE 1

Rain Table Testing

Various experiments were conducted in order to comparatively evaluate the functional performance of floor panels and flooring systems according to the disclosure and conventional floor panels and flooring systems. In a first example, eleven different 4-foot wide by 4-foot long rain tables were created using floor panels according to embodiments of the disclosure and conventional floor panels. Each rain table included two 2-foot by 4-foot panels and one joist. Some of the rain tables utilized a ⅛ inch gap between the two panels and others did not. The panels tested included oriented strand board (OSB) available from various sources including three different Weyerhaeuser mills (e.g., WY Mill 1, WY Mill 2, or WY Mill 3). All of the panels had a thickness of approximately 23/32 inches. Some of the panels were altered to include drainage assemblies according to embodiments of the disclosure. Table 1 below summarizes the specimens tested including their source and configuration.

Each of the rain tables were subjected to a 48-hour test involving four cycles of rain distributed on the tables about 12 hours about. Each rain cycle was approximately 60 minutes in duration. After all four rain cycles were complete, conventional techniques were used to measurethe percent water absorption in each floor panel. Table 1 summarizes the results.

TABLE 1

Rain Table Test Results

| Rain Table | Source of Panels | Drainage Assembly | Gap or No Gap | Water Absorption (%) |
|---|---|---|---|---|
| 1 | WY Mill 1 | None | Gap | 22% |
| 2 | WY Mill 1 | 2½ inch slot | No Gap | 16% |
| 3 | WY Mill 1 | 2½ inch slot | Gap | 5% |
| 4 | WY Mill 1 | 2½ inch slot and ⅛ inch square notch | Gap | 5% |
| 5 | WY Mill 1 | 2½ inch slot and ⅛ inch square notch | No Gap | 5% |
| 6 | WY Mill 1 | 2½ inch slot and 1 inch round notch | Gap | 4% |
| 7 | WY Mill 1 | 2½ inch slot and 1 inch round notch | No Gap | 6% |
| 8 | WY Mill 2 | None | Gap | 17% |
| 9 | WY Mill 2 | 2½ inch slot and 1 inch round notch | Gap | 6% |
| 10 | WY Mill 3 | None | Gap | 25% |
| 11 | WY Mill 3 | 2½ inch slot and 1 inch round notch | Gap | 6% |

Each of the rain tables were subjected to a 48-hour test involving four cycles of rain distributed on the tables about 12 hours about. Each rain cycle was approximately 60 minutes in duration. After all four rain cycles were complete, conventional techniques were used to measure the percent water absorption in each floor panel. Table 2 summarizes the results. As shown, panels sourced from the same mill absorbed significantly less water when drainage assemblies according to the disclosure were used.

EXAMPLE 2

Rain Floor Tests

In a third example, larger scale rain floors were constructed in order to further evaluate the functional performance of floor panels and flooring systems according to the disclosure and conventional floor panels and flooring systems. Three different 12-foot wide by 16-foot long rain tables were created using six 4-foot by 8-foot floor panels arranged onjoists in a staggered fashion similar to that shown in FIGS. 24, 25, 31, and 31. A 2 inch by 4 inch sill plate was installed around the perimeter of each rain floor. Some of the rain floors utilized a ⅛ inch gap between the panels and others did not. The panels tested included oriented OSB available from various sources including three different Weyerhaeuser mills. All of the panels had a thickness of approximately 23/32 inches. Some of the panels were altered to include drainage assemblies according to embodiments of the disclosure. Table 2 below summarizes the specimens tested including their source and configuration.

Before construction of the rain floors, the initial weight and thickness of each panel was measured. Each rain floor was exposed to approximately 60 minutes of water simulating rain every 24 hours for 3 days. Measurements were taken with a water capacitance meter at various points over the three-day period. At the end of the test, the overall water absorption was measured using conventional techniques. Table 3 summarizes the water absorption measured for each rain floor. Table 4 summarizes the water capacitance meter readings for each rain floor.

TABLE 2

Rain Floor Test Results (Overall Water Absorption)

| Rain Table | Source of Panels | Drainage Assembly | Gap or No Gap | Water Absorption (%) |
|---|---|---|---|---|
| 1 | WY Mill 1 | 2½ inch slot with ⅛ inch square notch | No Gap | 3% |
| 2 | WY Mill 1 | 2½ inch slot with ⅛ inch square notch | Gap | 3% |
| 3 | WY Mill 1 | None | Gap | 10% |

TABLE 3

Rain Floor Test Results (Moisture Content Over Time)

| Rain Table | Source of Panels | Day 2 Moisture Content (%) | Day 3 Moisture Content (%) | Day 4 Moisture Content (%) |
|---|---|---|---|---|
| 1 | WY Mill 1 | 8% | 10% | 11% |
| 2 | WY Mill 1 | 7% | 9% | 11% |
| 3 | WY Mill 1 | 7% | 16% | 32% or greater |

The results clearly demonstrate that rain floor constructed using floor panels according to embodiments of the disclosure absorbed less water overall. In addition, the moisture content readings for the rain floors utilizing floor panels according to embodiments of the disclosure also indicated lower moisture content than floors without drainage assemblies using panels from the same mill.

EXAMPLE 3

Rain Floor with Sawdust Tests

In a fourth example, sawdust was introduced into the rain floor tests described in Example 3 to simulate a building construction environment. Seven different rain floors were constructed having the same dimensions and general configuration as the rain floors in Example 3. Six rain floors were constructed from OSB panels sourced from Weyerhaeuser mills. The other rain floor was constructed using OSB panels from a competitor that are manufactured with chemical additives designed to reduce water absorption. Table 4 below summarizes the specimens tested including their source and configuration.

Sawdust was produced in a quantity of about 500 grams using a standard chop saw and deposited in a line on each rain floor. The sawdust was then swept with a broom across each rain floor in a direction substantially perpendicular to the transverse surfaces (e.g., the 4 foot ends) of the panels in order to fill the ⅛ inch gap (if present) between the panels. The remaining sawdust was then collected and spread in the center of each rain floor.

Each rain floor was exposed to approximately 60 minutes of water simulating rain every 24 hours for 3 days. In addition, a small amount of sawdust was swept into the gaps and/or panel surface in each of the rain floor. Measurements were taken with a water capacitance moisture meter at various points on the surface of each panel over the three-day period. At the end of the test, the overall water absorption was measured using conventional techniques. Table 4 summarizes the water absorption measured for each rain floor. Table 5 summarizes the water capacitance moisture meter readings for each rain floor.

TABLE 4

Rain Floor with Sawdust Test Results (Overall Water Absorption)

| Rain Floor | Source of Panels | Drainage Assembly | Gap or No Gap | Water Absorption (%) |
|---|---|---|---|---|
| 4 | WY Mill 1 | 2½ inch slot | Gap | 7% |
| 5 | WY Mill 1 | None | Gap | 17% |
| 6 | WY Mill 1 | 2½ inch slot with ⅛+12square notch | No Gap | 15% |
| 7 | WY Mill 1 | 2½ inch slot with ⅛ square notch | Gap | 9% |
| 8 | Competitor | None | Gap | 14% |
| 9 | WY Mill 1 | 2½ inch slot and 1 inch round notch | Gap | 4% |
| 10 | WY Mill 1 | 2½ inch slot and 1 inch round notch | No Gap | 6% |

TABLE 5

Rain Floor with Sawdust Test Results (Moisture Content Over Time)

| Rain Floor | Source of Panels | Day 2 Moisture Content (%) | Day 3 Moisture Content (%) | Day 4 Moisture Content (%) |
|---|---|---|---|---|
| 4 | WY Mill 1 | 10% | 10% | 15% |
| 5 | WY Mill 1 | 32% or greater | 32% or greater | 32% or greater |
| 6 | WY Mill 1 | 20% | 22% | 24% |
| 7 | WY Mill 1 | 13% | 20% | 28% |
| 8 | Competitor | 16% | Standing water | Standing water |
| 9 | WY Mill 1 | 6% | 7% | 9% |
| 10 | WY Mill 1 | 9% | 9% | 13% |

The results above indicate that rain floors constructed according to embodiments of the disclosure (e.g., Rain Floors 4, 6, 7, 9, and 10) absorbed less water overall. In addition, the moisture content readings for the rain floors utilizing floor panels according to embodiments of the disclosure also indicated lower moisture content than floors without drainage assemblies using panels from the same mill.

I claim:

1. A flooring drainage system, comprising:

(a) first and second floor panels each comprising:

(i) a top surface;

(ii) a bottom surface that is substantially parallel to the top surface;

(iii) a first longitudinal surface having a longitudinally-extending tongue protruding therefrom;

(iv) a second longitudinal surface having a longitudinally-extending groove extending inwardly therefrom;

(v) a first transverse surface that is substantially perpendicular to the first longitudinal surface and the second longitudinal surface;

(vi) a second transverse surface opposite the first transverse surface, the second transverse surface substantially perpendicular to the first longitudinal surface and the second longitudinal surface, wherein the first transverse surface and the second transverse surface are substantially shorter in length than the first longitudinal surface and the second longitudinal surface; and (b) at least one drainage assembly defined between the first transverse surface of the first floor panel and the second transverse surface of the second floor panel when the first transverse surface of the first floor panel is positioned substantially adjacent to the second transverse surface of the second floor panel, each of the at least one drainage assemblies defined by:

(i) a drainage slot defined on the bottom surface of the first floor panel, the drainage slot extending from the first transverse surface towards the second transverse surface; and (ii) a drainage notch extending into the second transverse surface of the second floor panel and from the top surface of the second floor panel toward the bottom surface of the second floor panel, wherein the drainage notch is substantially aligned with the drainage slot to facilitate entry of water into the drainage slot.

2. The system of claim 1, wherein the drainage notch defines a notch height extending from a first notch height location that is in substantial alignment with the top surface of the second floor panel to a second notch height location between the top and bottom surfaces of the second floor panel, wherein the drainage slot defines a slot height extending from a first slot height location in substantial alignment with the bottom surface of the first floor panel to a second slot height location between the second notch height location and the top surface of the second floor panel when the top surfaces of the first and second floor panels are substantially coplanar.

3. The system of claim 2, wherein the second notch height location is in substantial alignment with the bottom surface of the first floor panel.

4. The system of claim 2, wherein the drainage slot defines a slot depth extending at least about 2½ inches into the first transverse surface.

5. The system of claim 2, wherein the drainage slot defines a slot depth extending approximately ¾ inches to approximately 3 inches into the first transverse surface and a slot height of less than ¾ of the panel thickness.

6. The system of claim 2, wherein the drainage notch defines a notch depth extending approximately 1/16 inches to approximately ¼ inches into the second transverse surface and a notch width approximately ⅛ inches to 3 inches wide.

7. The system of claim 2, wherein the drainage slot decreases in height and width as the drainage slot extends from the first transverse surface toward the second transverse surface.

8. The system of claim 1, wherein a gap is defined between the first transverse surface of the first floor panel and the second transverse surface of the second floor panel when the first transverse surface of the first floor panel is positioned substantially adjacent to the second transverse surface of the second floor panel.

9. The system of claim 1, wherein the first floor panel further includes a drainage notch extending into the second transverse surface of the first floor panel and from the top surface of the first floor panel toward the bottom surface of the first floor panel.

10. The system of claim 1, wherein the second floor panel further includes a drainage slot defined on the bottom surface of the second floor panel, the drainage slot extending from the first transverse surface towards the second transverse surface.

11. The system of claim 1, wherein the drainage notch has a substantially semi-circular profile when viewed from the top surface.

12. The system of claim 1, wherein the drainage notch has a substantially rectangular profile when viewed from the top surface.

13. The system of claim 1, wherein the first transverse surface of the first floor panel has a first end defined by the intersection of the first transverse surface and the first longitudinal surface and a second end defined at the intersection of the first transverse surface and the second longitudinal surface, and wherein the drainage slot located on the first transverse surface is spaced inwardly from the first and second ends of the first transverse surface.

14. The system of claim 1, wherein the second transverse surface of the second floor panel has a first end defined by the intersection of the second transverse surface and the first longitudinal surface and a second end defined at the intersection of the second transverse surface and the second longitudinal surface, and wherein the drainage notch located on the second transverse surface is spaced inwardly from the first and second ends of the second transverse surface.

15. A floor panel, comprising:

(a) a top surface;

(b) a bottom surface that is substantially parallel to the top surface;

(c) a first longitudinal surface having a longitudinally-extending tongue protruding therefrom;

(d) a second longitudinal surface having a longitudinally-extending groove extending inwardly therefrom;

(e) a first transverse surface that is substantially perpendicular to the first longitudinal surface and the second longitudinal surface;

(f) a second transverse surface opposite the first transverse surface, the second transverse surface substantially perpendicular to the first longitudinal surface and the second longitudinal surface, wherein the first transverse surface and the second transverse surface are substantially shorter in length than the first longitudinal surface and the second longitudinal surface;

(g) a drainage slot defined on the bottom surface, the drainage slot extending from the first transverse surface towards the second transverse surface; and (h) a drainage notch extending into the second transverse surface and from the top surface toward the bottom surface, wherein the drainage notch defines a notch height extending from a first notch height location that is in substantial alignment with the top surface of the floor panel to a second notch height location between the top and bottom surfaces of the floor panel, and wherein the drainage slot defines a slot height extending from a first slot height location in substantial alignment with the bottom surface of the floor panel to a second slot height location between the second notch height location and the top surface of the floor panel.

16. The floor panel of claim 15, wherein the drainage slot and the drainage notch are in substantial alignment with a first longitudinal axis of the floor panel.

17. The floor panel of claim 15, wherein the drainage slot decreases in height and width as the drainage slot extends from the first transverse surface toward the second transverse surface.

18. The floor panel of claim 15, wherein the drainage slot has a substantially arcuate profile when viewed from the first transverse surface.

19. A floor panel, comprising:

(a) a top surface;

(b) a bottom surface that is substantially parallel to the top surface;

(c) a first longitudinal surface having a longitudinally-extending tongue protruding therefrom;

(d) a second longitudinal surface having a longitudinally-extending groove extending inwardly therefrom;

(e) a first transverse surface that is substantially perpendicular to the first longitudinal surface and the second longitudinal surface;

(f) a second transverse surface opposite the first transverse surface, the second transverse surface substantially perpendicular to the first longitudinal surface and the second longitudinal surface, wherein the first transverse surface and the second transverse surface are substantially shorter in length than the first longitudinal surface and the second longitudinal surface;

(g) a drainage slot defined on the bottom surface, the drainage slot extending from the first transverse surface towards the second transverse surface, the drainage slot in a predetermined location on the first transverse surface between the first and second longitudinal surfaces; and (h) a drainage notch extending into the second transverse surface and from the top surface toward the bottom surface, wherein the drainage notch is in a predetermined location on the second transverse surface between the first and second longitudinal surfaces that substantially corresponds to the predetermined location of the drainage slot on the first transverse surface.

20. The floor panel of claim 19, wherein the drainage slot decreases in height and width as the drainage slot extends from the first transverse surface toward the second transverse surface.

* * * * *